US007111934B2

(12) United States Patent
Okuda et al.

(10) Patent No.: US 7,111,934 B2
(45) Date of Patent: Sep. 26, 2006

(54) RECORDING MEDIUM FEEDING APPARATUS, RECORDING APPARATUS, LIQUID EJECTING APPARATUS

(75) Inventors: Yasumichi Okuda, Nagano-ken (JP); Kazuo Otsuka, Nagano-ken (JP); Keiichiro Fukumasu, Nagano-ken (JP); Katsuhiko Tachikawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 110 days.

(21) Appl. No.: 10/956,761

(22) Filed: Oct. 1, 2004

(65) Prior Publication Data

US 2005/0168501 A1 Aug. 4, 2005

(30) Foreign Application Priority Data

Oct. 2, 2003 (JP) ..... 2003-344980
Sep. 16, 2004 (JP) ..... 2004-269365

(51) Int. Cl.
*B65H 1/08* (2006.01)

(52) U.S. Cl. ..... 347/104; 271/117; 271/162; 271/167

(58) Field of Classification Search ..... None
See application file for complete search history.

(56) References Cited

U.S. PATENT DOCUMENTS 4,303,235 A * 12/1981 Calabrese ..... 271/162
4,896,871 A * 1/1990 Idenawa ..... 271/9.09
4,991,830 A * 2/1991 Yamanaka ..... 271/9.08
5,326,091 A * 7/1994 Giacometto et al. ..... 271/10.01
5,383,655 A * 1/1995 Hayakawa et al. ..... 271/10.01
5,775,688 A * 7/1998 Kato et al. ..... 271/167

FOREIGN PATENT DOCUMENTS

JP 2000-95662 4/2000

* cited by examiner

*Primary Examiner*—Andrew H. Hirshfeld
*Assistant Examiner*—Jill E. Culler
(74) *Attorney, Agent, or Firm*—John J. Penny, Jr.; Edwards Angell Palmer & Dodge LLP

(57) ABSTRACT

The feeding apparatus 50 includes a hopper 51 that is provided operable to support the papers in inclined attitude and pivot around a pivot axis 51*a*, and a feed roller 53 that is provided at a feed roller shaft 54 and feeds the paper to the downstream side by rotating in contact with the paper. When seen from the side view of the feeding path, guide rollers 57 and 58 are provided near the feed roller 53 and are driven to rotate in contact with paper. A movable member, provided near the feed roller 53, pivots around a pivot axis 63*a* so that the movable member moves backward and forward to the feeding path. Accordingly, a clearance between the feed roller 53 and the hopper 51 is narrowed.

19 Claims, 20 Drawing Sheets

RECORDING MEDIUM FEEDING APPARATUS, RECORDING APPARATUS, LIQUID EJECTING APPARATUS

This patent application claims priority from Japanese Patent Applications Nos. 2003-344980 filed on Oct. 2, 2003 and 2004-269365 filed on Sep. 16, 2004, the contents of which are incorporated herein by reference.

BACKGROUND OF THE INVENTION

1. Field of the Invention

The present invention relates to a recording apparatus. More particularly, the preset invention relates to a recording medium feeding apparatus that is operable to set a plurality of recording medium and feeds the recording medium one-by-one to a downstream, and a recording apparatus that includes the recording medium feeding apparatus. In addition, the present relates to a liquid ejecting apparatus.

Here, the liquid ejecting apparatus includes a printer, a copying machine or a facsimile which performs recording by ejecting ink from the recording head onto the recording medium using an ink-jet type recording head, as well as any apparatus which makes the liquid to be adhered onto an exposed media corresponding to the recording medium by ejecting any type of liquid suitable for a predetermined purpose instead of the ink from a liquid ejection head corresponding to the ink-jet type recording head.

Other than the above-mentioned recording head, the liquid ejection head includes a coloring-material ejection head used for color filter manufacturing such as a liquid crystal display, an electrode material (conductive paste) ejection head used for electrode formation of an organic EL display, a field emission display (FED), etc., and an organic substance ejection head used for biochip manufacture, a specimen ejection head as a precision pipette, and the like.

2. Description of the Related Art

As an example of the recording apparatus, the printer includes an Auto Sheet Feeder (ASF) which can set papers as the recording medium in inclined attitude. The ASF includes a feed roller, a hopper, a guide member, and a separating means. The hopper supports the papers to be in contact with the feed roller or to be separated from the feed roller, and it is possible to change these two states. The guide member includes an edge supporting part for supporting an edge of the papers that is set in inclined attitude, and a guide face for guiding the edge of the papers to a downstream side of the printing, opposed to the feed roller. The separate means separates a top paper that is to be fed in contact with the feed roller from the next papers. (CF. Japanese Patent Laid-Open No.2000-95362.)

Recently, it is desirable to prepare as many papers as possible at one action for the convenience when setting papers. In order to satisfy this requirement, it is necessary to make the clearance between the hopper and the feed roller a wide clearance, and this clearance is generated when the hopper separates from the feed roller. However, if the clearance is wide, the edge of the papers tends to bend when a few papers are set, and consequently the edge of the papers slips on the surface of the supporting part and then enters into a clearance between the feed roller and a guide face. This phenomenon is called "avalanche phenomenon" hereinafter. According to this avalanche phenomenon, the printer tends to feed multi papers with failure.

In addition, if the clearance between the hopper and the feed roller become wide, the attitude of the papers is not constant when the maximum number of the papers is set or the minimum number of the papers is set, and consequently the loads caused by transporting each of the papers is not constant. Therefore it is also desirable to reduce the loads in order to obtain consistent quality of recording.

SUMMARY OF THE INVENTION

The present invention is invented in view of situations as described above, and an object is to obtain a feeding apparatus that prevents the avalanche phenomenon of the papers and reduces the loads when transporting papers.

To achieve such objects, according to the first aspect of the present invention, a recording medium feeding apparatus includes a feed roller provided on a feed roller shaft that is rotatably driven to feed recording medium to a downstream side in the recording medium feeding apparatus in contact with the recording medium, a hopper provided pivotable between a first state in which the recording is abutted against the feed roller and a second state in which the recording medium is spaced apart from the feed roller, supporting the recording medium in inclined attitude and a narrowing means including a driven roller that is rotatably driven in contact with the recording medium at a contact position of the recording medium and a movable member provided near the feed roller and being movable backward and forward toward a feeding path of the recording medium, so that the narrowing means narrows a clearance between the feed roller and the hopper in the second state.

Accordingly, it is possible to prevent the avalanche phenomenon of the recording medium that is set in inclined attitude, and prevent the feeding of multi papers. In addition, it is possible to reduce the load of the transporting, and therefore, the quality of the recording becomes constant even if the maximum number of the recording medium is set or the minimum number of the recording medium is set.

According to the second aspect of the present invention, the movable member may escape from the feeding path in the first state, whereas the movable member may enter into the feeding path in the second state in order to narrow the clearance.

Accordingly since the movable member escapes from the feeding path at feeding of the recording medium and movable member enters into the feeding path in order to narrow the clearance at non-feeding, it is possible to realize the movement of the feeding not disturbing the hopper that is in contact with the feed roller at the feeding.

According to the third aspect of the present invention, the movable member may include a body of which a bottom face is provided to be opposed to the feeding path, a first driven roller provided at a upstream corner on the bottom part of the body; and a second driven roller provided at a downstream corner of the bottom part of the body.

Accordingly, the narrow means can be constructed simply with low cost. In addition, it is possible to reduce both a frictional resistance on a corner of the body where the recording medium tends to contact with the body and the load of transporting.

According to the fourth aspect of the present invention, the first driven roller and the second driven roller may be provided near an intersection position of a flat part of the feed roller and a circular arc part of the feed roller.

Accordingly, the frictional resistance on a corner of the feed roller where the recording paper tends to contacts, i.e. the intersection position of the flat part and the circular arc part, can be reduced and the load of transporting can be deduced more effectively.

According to the fifth aspect of the present invention, the body may be provided pivotable around a rotation shaft of the second driven roller, and may include a cam follower engaging with a cam that is provided at the feed roller shaft, so that the body moves backward and forward to the feeding path in accordance with rotation of the feed roller shaft.

Accordingly it is possible to realize the movement of moving backward and forward in accordance with rotating movement of the feed roller, i.e. in accordance with the timing of the feeding of the recording medium.

According to the sixth aspect of the present invention, a recording medium feeding apparatus includes a feed roller provided on a feed roller shaft that is rotatably driven to feed recording medium to a downstream side in the recording medium feeding apparatus in contact with the recording medium, a hopper provided pivotable between a first state in which the recording medium abutted against the feed roller and a second state in which the recording medium is spaced from the feed roller supporting the recording medium in inclined attitude and an edge supporting part for supporting an edge of the recording medium that is supported by the hopper in the inclined attitude. A first guide part for guiding the edge of the recording medium to the edge supporting part when the recording medium is set, and a second guide part for guiding the edge of the recording medium to a downstream side of the edge supporting part when the recording medium is fed, intersect together to form a corner, and the corner at a guide member that is provided operable to be displaced in the feeding path of the recording medium is formed to be covered with a circumference of the driven roller.

Accordingly, the recording medium can be prepared smoothly in the case of setting the recording medium due to the first guide part and the recording medium also can be transported without fail. Since the corner that is intersected by the first guide part and the second guide part is covered with the circumference of the driven guide roller, it is possible to feed the recording medium to the downstream side smoothly, not causing damage to the surface of the recording medium when the recording medium is fed.

According to the seventh aspect of the present invention, a recording medium feeding apparatus includes a feed roller provided on a feed roller shaft that is rotatably driven to feed recording medium to a downstream side of the recording medium feeding apparatus in contact with the recording medium, a hopper provided pivotable between a first state in which the recording medium abutted against the feed roller and a second state in which the recording medium is spaced from the feed roller supporting the recording medium in inclined attitude, an edge supporting part for supporting an edge of the recording medium that is supported by the hopper in the inclined attitude, a separation means for nipping the recording medium between the feed roller and the separation means in order to separate top recording medium to be fed from following recording medium next to the top recording medium and a guide member that is provided operable to be displaced in the feeding path of the recording medium, wherein the guide member includes, a first guide part for guiding the edge of the recording medium to the edge supporting part when the recording medium is set, a second guide part for guiding the edge of the recording medium to the separating means a downstream side of the edge supporting part when the recording medium is fed and a driven roller which is provided at a upstream side of the second guide part and is rotatably driven in contact with the recording medium.

Accordingly, the first guide part can set the recording medium smoothly in case of setting the recording medium, and the second guide part can transport the recording medium to the downstream side without fail. In addition, since the driven roller is provided at an upstream side in contact with the recording medium, it is possible to transport the recording medium smoothly to the downstream side.

According to the eighth aspect of the present invention, the recording apparatus including a recording part for recording in recording medium may includes any one of the recording medium feeding apparatus cited in from the first aspect to seventh aspect mentioned above.

According to the eighth aspect, each of the recoding apparatuses includes any one of the recording medium feeding apparatuses (Auto Sheet Feeders) in the first aspect to seventh aspect, therefore, each of the recoding apparatuses can obtain one of the same advantages corresponding to each aspects mentioned above.

According to the ninth aspect of the present invention, a liquid ejecting apparatus includes a feed roller formed to be substantially D-shaped in side view including a circular arc part and a flat part, and provided at a feed roller shaft that is rotatably driven, thereby rotating in contact with the recording medium to feed ejected medium to a downstream side in the liquid ejecting apparatus, a hopper provided pivotable between a first state in which the recording is abutted against the feed roller and a second state in which the recording medium is spaced apart from the feed roller, supporting the recording medium in inclined attitude, a transport means provided in a downstream side of the feed roller to transport the ejected medium to the downstream side, a liquid ejecting means provided in a downstream side of the transport means to eject liquid to the ejected medium and a narrowing means including a driven roller that is rotatably driven in contact with the recording medium at a contact position of the recording medium and a movable member that is provided near the feed roller being movable backward and forward toward a feeding path of the recording medium, so that the narrowing means narrows a clearance between the feed roller and the hopper in the second state.

According to the tenth aspect of the present invention, a recording medium feeding apparatus for feeding recording medium includes a frame, a feed roller shaft rotatably supported on the frame, a feed roller rotatably supported on the feed roller shaft in contact with the recording medium, a hopper supporting the recording medium at an upstream side of the recording medium feeding apparatus, and supported on the frame in an inclined attitude corresponding to a vertical direction of the recording medium feeding apparatus being pivotable between a first position where the recording medium is elastically abutted against the feed roller and a second position spaced apart from the feed roller and a body provided near a downstream part of the hopper and the feed roller, and the body includes a first guide part, and a driven roller rotatably that is supported on the first guide part where the driven roller contacts the recording medium when the body is in the first position, and the driven roller is urged in a direction toward the hopper operatively in association with the feed roller.

The recording medium feeding apparatus further includes a retard roller rotatably supported by the frame at a position downstream of said hopper, and the friction between the retard roller and the recording medium may be larger than that between one recording medium and another recording medium. In addition, the friction between the feed roller and the recording medium is larger than that between one recording medium and another recording medium, when the hopper stands at the first position.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

An embodiment according to the present invention will be explained in an order, i.e. the outline of the ink-jet type printer 1, and the detail of the feeding apparatus (Auto Sheet Feeder), with reference to drawings.

1. Outline of an Ink-jet Type Printer 1

Figure 1:
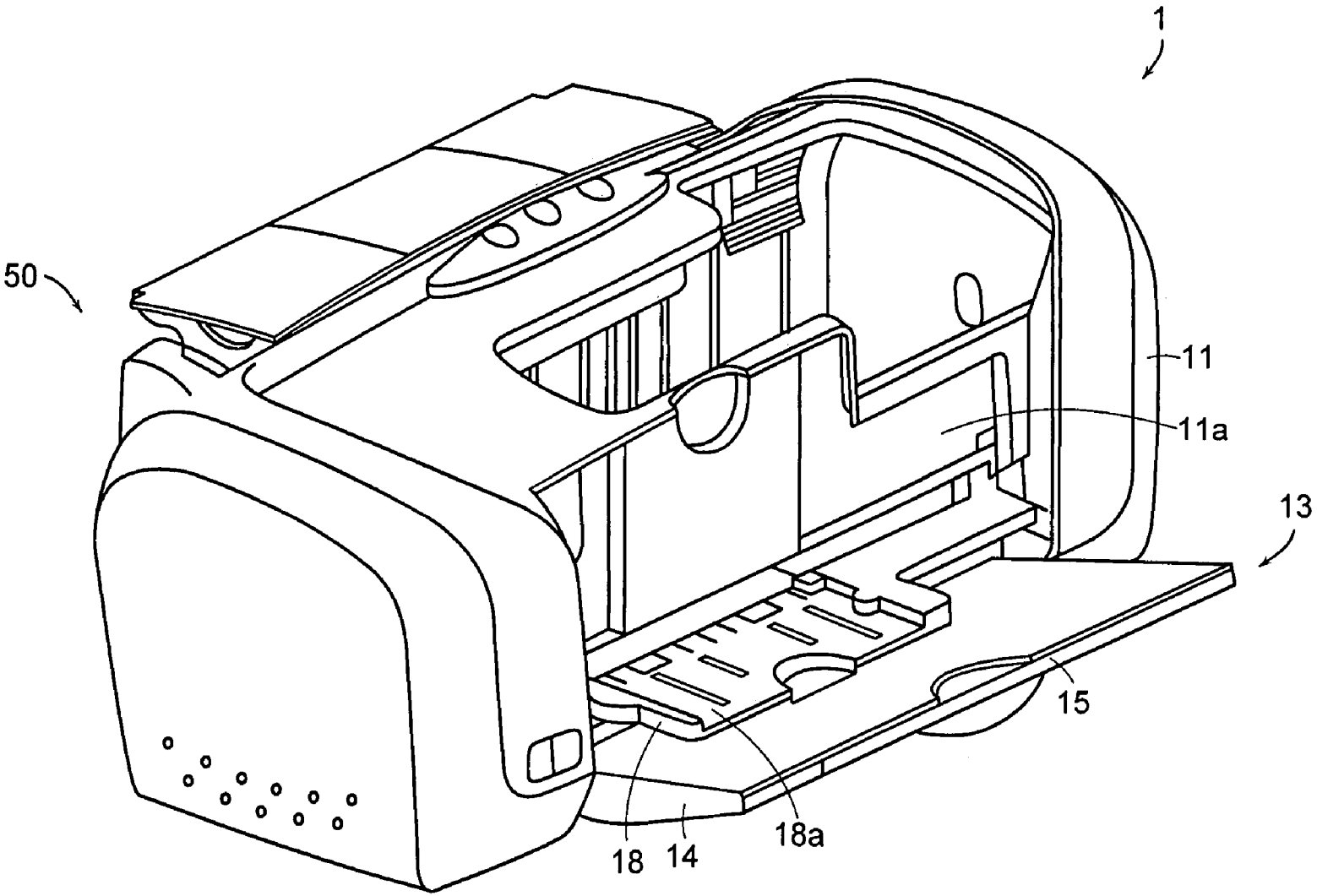
FIG. 1 is a perspective view of a printer 1 according to the present invention.
Figure 2:
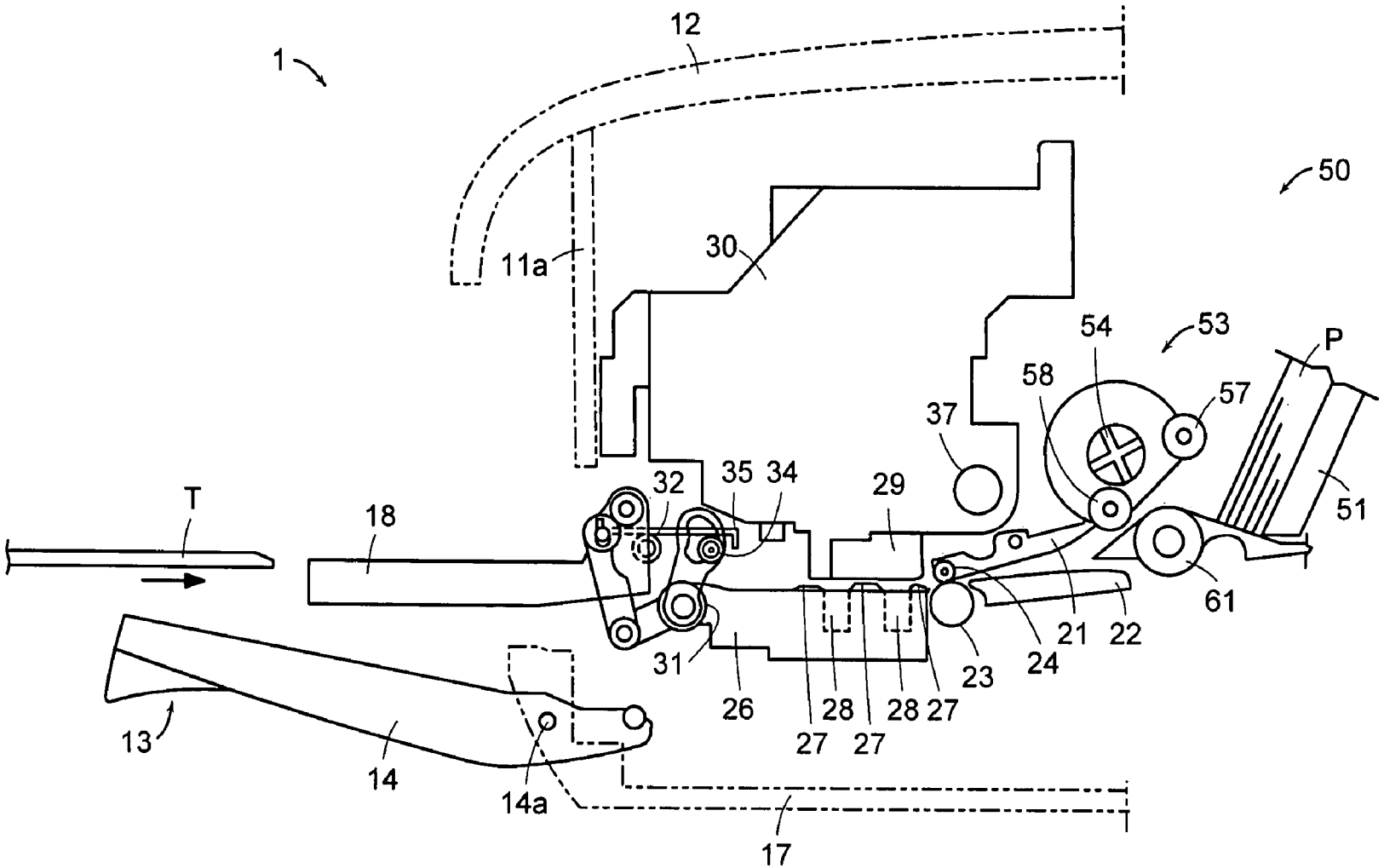
FIG. 2 is a sectional side view of the printer 1 according to the present invention.

As an exemplary of "a recording apparatus", and "a liquid ejecting apparatus", the configuration of the ink-jet type printer 1 will be explained with reference to the FIGS. 1 and 2. Hereinafter, the "ink-jet type printer" is simply called "printer". FIG. 1 shows a perspective view of the printer 1. FIG. 2 shows a sectional side view of the printer 1. In addition, in this embodiment, a left side in FIG. 2, i.e. a front side of the printer is defined as "a downstream side" in case of transporting papers or feeding papers, and a right side in FIG. 2, i.e. a rear side of the printer is defined as "an upstream side".

The printer 1 includes a feeding apparatus 50 setting a number of recording papers at a rear part. The feeding apparatus 50 is an exemplary of "a recording medium feeding apparatus" and recording paper is an exemplary of "a recording medium" and "an ejecting medium". The recording paper is called "paper P" hereinafter. The printer 1 further includes a stacker 13 on a lower case 17 (see FIG. 2) that forms a bottom part of the printer 1. The stacker 13 is constructed to be movable between an opening state where the stacker 13 stacks the paper P, and a closing state where stacker 13 is closed, and the stacker 13 in the closing state is substantially vertical to the stacker 13 in the opening state. The stacker 13 includes a stacker body 14 and a sub-stacker 15. The stacker 13 is operable to rotate around a stacker body 14*a* (see FIG. 2) of the stacker body 14. In a state in which the stacker 13 is opened by rotating toward the front of the printer 1, when the sub-stacker 15 is brought from the stacker body 14, a stacking surface is formed.

A top part of the printer 1 is cover with a housing 11. In addition, a cover 12 is provided at a top center part of the housing 11, and the cover 12 is operable to open or close for some operations such as an exchange of the ink cartridge. The feeding apparatus 50, the stacker 13, the housing 11 and the upper cover 12 form an appearance of the printer 1.

Next, the transport path of the paper P (the feeding path of the paper P) will be explained with reference to the FIG. 2. In FIG. 2, the feeding apparatus 50 includes a hopper 51, a feed roller 53, a retard roller 61, a guide rollers 57 and 58. The feeding apparatus 50 feeds a top paper of the set papers P one-by-one to "a transport means", which includes a transport driving roller 23 and a transport driven roller 24, and transports the paper P to a recording head 29.

More specifically, the hopper 51 is plate-like shaped and is constructed to pivot around a pivot axis 51*a* (see FIG. 5) that is provided at a top part of the hopper 51. The hopper 51 is pivotable between a first position in which the hopper 51 supports the paper P in inclined attitude to be in abutting contact with the feed roller 53 and a second position in which the hopper 51 supports the paper P to be spaced apart from the feed roller 53, by using a cam means and a urging means that are described below. Here, "abutting contact" means that the paper P is pushed to the feed roller by the hopper 51 and consequently, the paper P and the feed roller contact together. The feed roller 53 is substantially formed to be D-shaped in side view. The feed roller 53 is formed with a feed roller shaft 54 from resin material, and robber material is wound around the feed roller 53. The feed roller 53 includes a plat part and a circular arc part. When feeding a paper to a downstream side, the feed roller 53 feeds the paper in abutting contact with the circular arc part, whereas when the transport driving roller 23 and the transport driven roller 24 transports the paper, the feed roller 53 is controlled so that the flat part is opposed to the paper as shown in the FIG. 5, not to generate the load of transporting.

The retard roller 61 performs as "a separation means" for separating the top paper to be fed from the next papers P. The retard roller 61 is provided so that the retard roller 61 is in abutting contact with the circulate arc part of the feed roller 53 and so that a certain rotational resistance is given. When the event of feeding the multi papers does not happen, i.e. when only one paper P is fed, the retard roller 61 is driven to rotate in accordance with the paper (clockwise rotation in FIG. 2). On the contrary, when there are multi papers P between the feed roller 53 and the retard roller 61, the retard roller 61 is constructed to stop its rotation because of the low friction coefficient among the papers. Therefore, the following papers P that is going to be driven by the fed top paper P are not transported to the downstream side, and consequently the feeding of the multi papers is prevented. Specifically, the retard roller 61 is rotatably supported by the frame 65 at a position downstream of the hopper 51, and the friction between the retard roller 61 and the paper P is larger than that between one paper P and another paper P. In addition, the friction between the feed roller 53 and the paper P is larger than that between one paper P and another paper P, when the hopper 51 stands at the first position. Here, the one paper P in contact with the feed roller 53 is the top paper P. Therefore, even if multi papers exit between the retard roller 61 and the feed roller 53, only the top paper P is transported to the downstream side.

Figure 3:
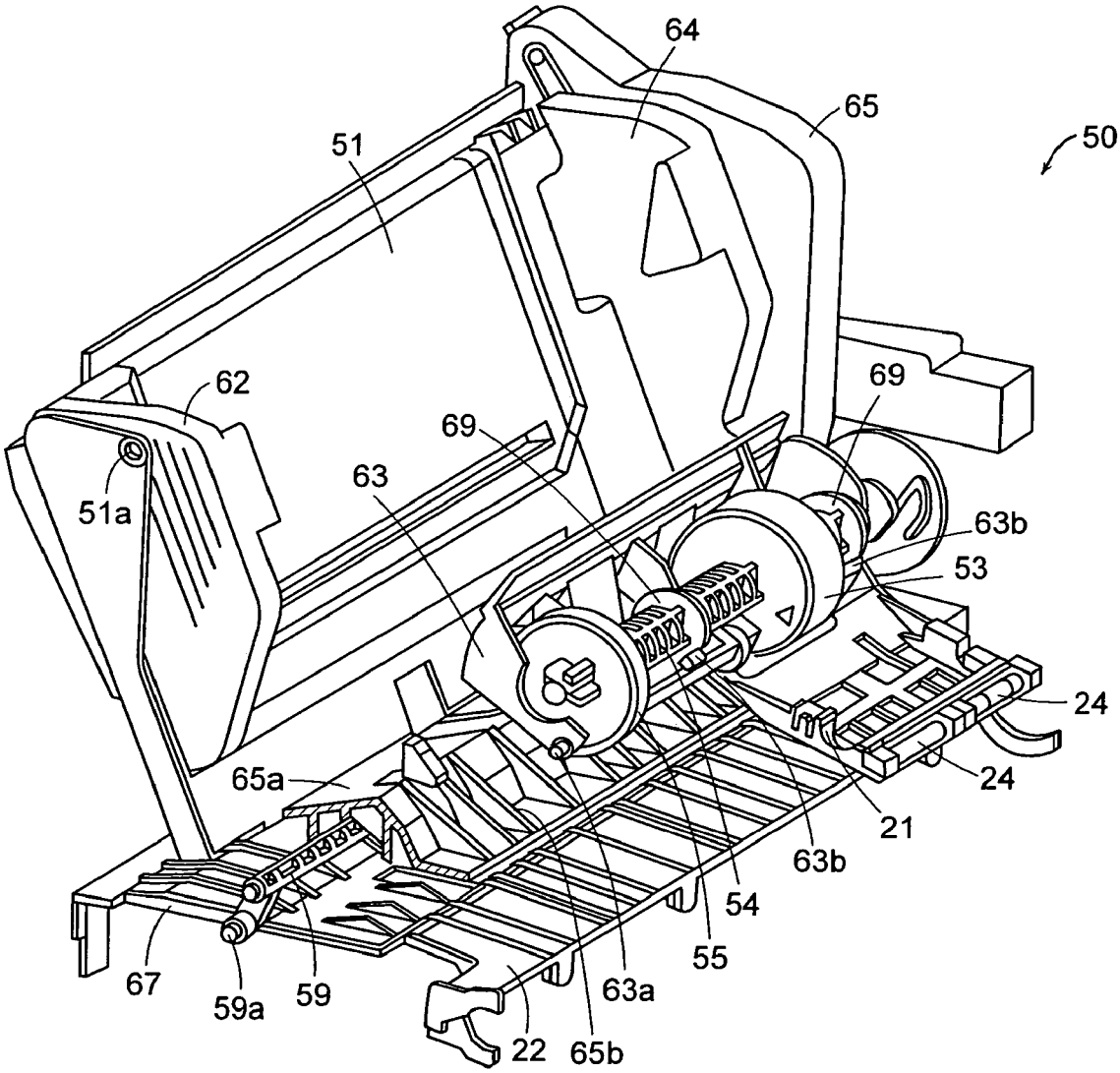
FIG. 3 is a perspective view of a feeding apparatus 50 according to the present invention.

The guide rollers 57 and 58 are supported by some shafts in a body 63 so that the guide rollers 57 and 58 rotate freely (see FIG. 3). The guide rollers 57 and 58 perform to eliminate the load of transporting, not to allow the paper P to contact both the body 63 and the feed roller 63. The detail of the guide rollers 57 and 58 is described below. Although the feeding apparatus 50 includes other elements, the details of these elements are also described below.

Next, the paper P fed by the feeding apparatus 50 is guided by the guide 22, and then reaches to the transport driving roller 23 and transport driven roller 24. The transport driving roller 23 is driven by a motor (not shown) and the transport driven roller 24 is driven to rotate in abutting contact with the transport driving roller 23. The transport driven roller 24 is supported by a holder 21 which performs as a shaft, and the holder 21 is provided at a frame (not shown) via a spring (not shown). The frame is constructed as a basic body of the printer 1. The paper P at the transport driving roller 23 is transported to the downstream side with a predetermined pitch according to the rotation of the transport driving roller 23.

An ink-jet recording head 21 (hereinafter "recording head 21") and a platen 26 are provided at the downstream side of the transport driving roller 23 so that the recording head 21 and the platen 26 are opposed together. The recording head 29 is provided at the bottom part of a carriage 30. The carriage 30 is driven to reciprocate along a main scanning direction by a drive motor (not shown), supported by the carriage guide shaft 37 that extends along the main scanning direction. In addition, the carriage 30 mounts an ink cartridge that includes a plurality of color inks independently, and supplies these ink to the recording head 29.

The platen 26 includes a function of deciding a distance between the papers P and the recording head 29, and in the platen 26, three ribs 27 and two concave parts 28 are formed on the surface of the platen 26, and this surface is opposed to the recording head 29. The concave parts 28 are used to discard ink that is ejected to an outside region of an edge part on the papers P. Thus, it is possible to print a paper not having any white margin at its edge part. In addition, an ink absorbing material is provided at the concave parts 28 in order to absorb the discarded ink, and the absorbed ink is lead to a waste liquid tray that is provided at a bottom part of the platen 26.

An auxiliary roller 34, a discharge driving roller 31 and a discharge driven roller 32 are provided at the downstream side of the recording head 29. The discharge driving roller 31 is driven to rotate by a motor (not shown). The discharge driven roller 32 is driven to rotate in accordance with the discharge driving roller 31 in contact with discharge driving roller 31. Accordingly, the printed papers P are discharged to the stacker 13. A plurality of discharge driven rollers 32 are provided at a frame 35 that is made of metal extending along the main scanning direction. When a tray T in which an optical disc, as an example of the recording medium, is set, is transported, the frame 35 is displaced upward so that the discharge driven roller 32 separates from the discharge driving roller 31. In addition, the auxiliary roller 34 is driven to rotate in contact with the printed surface of the paper P, so that the auxiliary roller 34 prevents the lift of the paper P, and performs to keep the distance between the paper P and the recording head 29 constant.

Although the outline with respect to feeding path is described above, the printer 1 is constructed operable to print the label surface of the optical disc such as a compact disc, besides the paper P as recording medium. The optical disc D is set to the plate-like shaped tray T and then transported through the feeding path. The tray T and the printer 1 are constructed separately, and the tray T is inserted into the printer 1 from the font side, supported by the tray guide 18.

The tray guide 18 is provided at the downstream side of the discharge driving roller 31 and the discharge driven roller 32 so that the tray guide 18 is operable to open or close. In this case, the tray guide 18 is provided so that the tray guide 18 is operable to pivot between an opening state in which the tray guide 18 is hinged in horizontal attitude (see FIGS. 1 and 2) to support the tray T and a closing state in which the tray guide 18 is hinged in vertical attitude (not shown). The mentioned-above frame 35 is displaced upward or downward in accordance with the opening or closing of the tray guide 18. In the opening state of the tray guide 18, the frame 35 is displaced upward, so that the discharge driven roller 32 separates from the discharge driving roller 31 as shown in FIG. 2. In the closing state of the tray guide 18, the frame 35 is displaced downward, so that the discharge driven roller 32 contacts discharge driving roller 31.

The tray guide 18 and the stacker 13 perform similarly when opening or closing. In other words, in the closing state, each of the tray guide 18 and the stacker 13 stands keeping the vertical attitude, and then each of the tray guide 18 and the stacker 13 pivots and falls to the frontward, changing from vertical attitude to horizontal attitude, in order to open, and therefore, the tray guide 18 and the stacker 13 are in use. In the closing state, the tray guide 18 is positioned at an inside of the stacker 13, substantially parallel to the stacker 13. In the opening state, the tray guide 18 is positioned at an upper side of the stacker 13, substantially parallel to the stacker 13, and then the stacker 13 is kept in an attitude inclined slightly upward not to drop the discharged papers P.

2. The Detail of the Feeding Apparatus

A detail configuration of the feeding apparatus 50 will be explained in an order, i.e. the narrow means for narrowing a clearance between the feed roller 53 and the hopper 51, the pivot axis of the hopper 51, the cam means for pivoting the hopper 51, and the lever 59.

2-1. The Narrow Means for Narrowing a Clearance Between the Feed Roller 53 and the Hopper 51.

Figure 4:
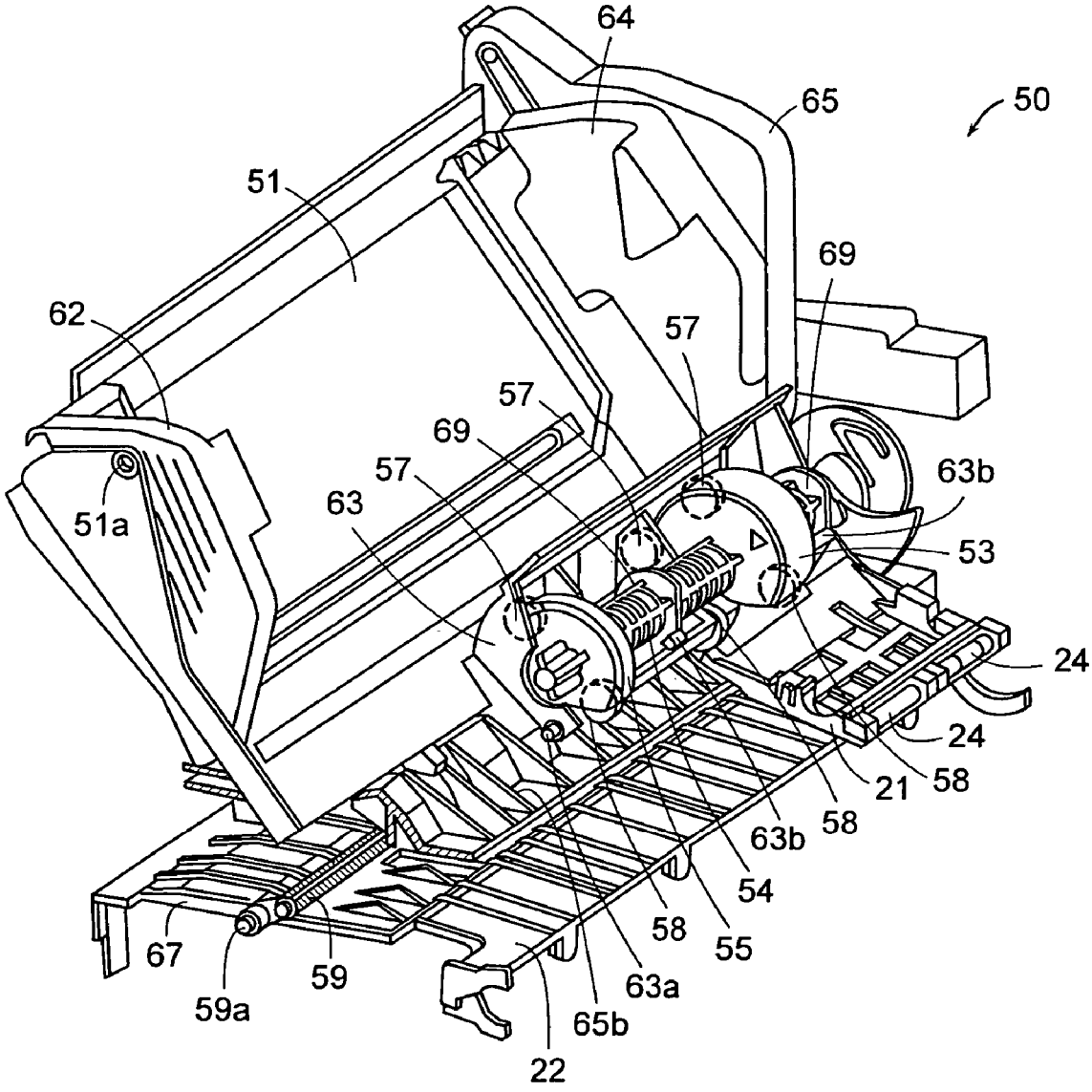
FIG. 4 is a perspective view of the feeding apparatus 50 according to the present invention.
Figure 5:
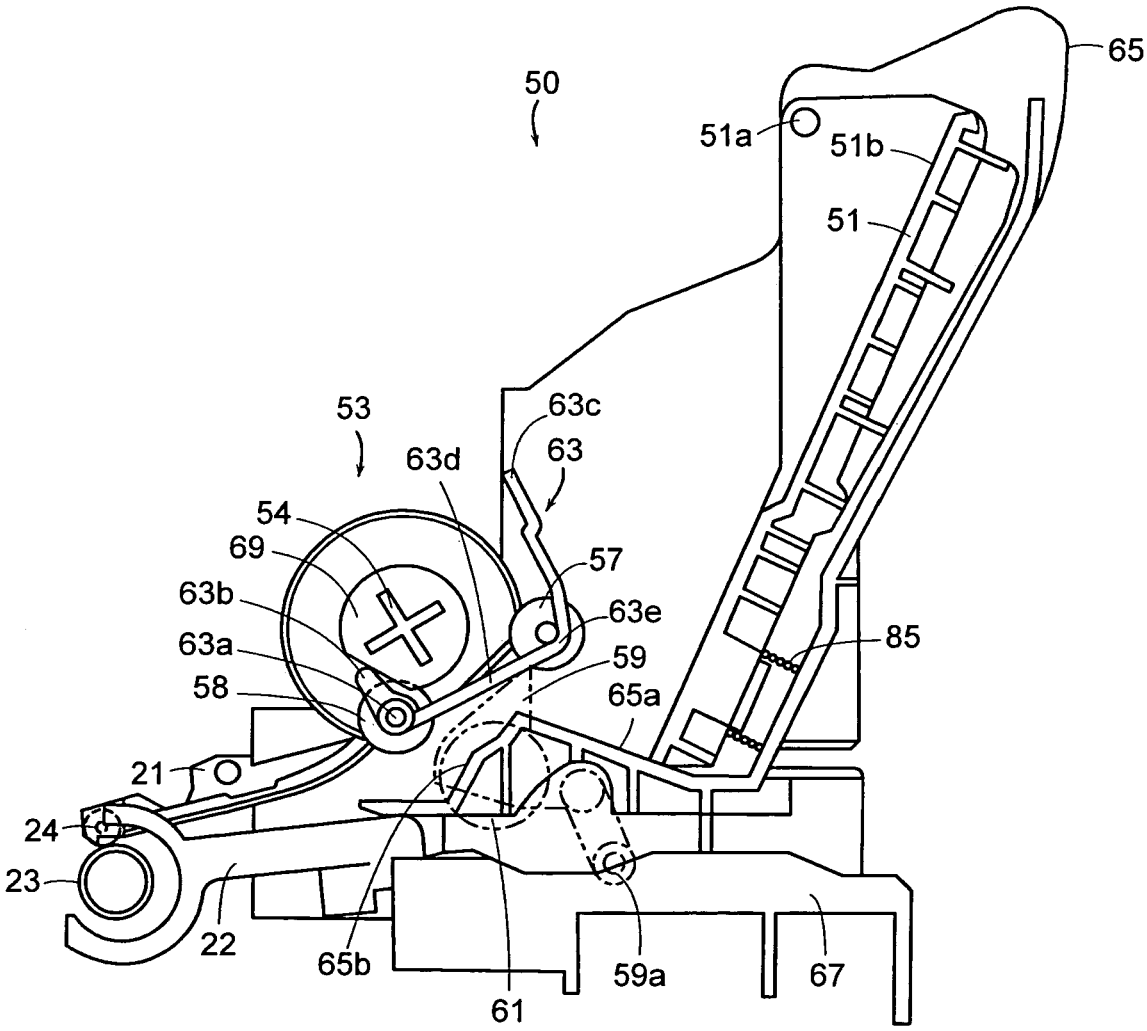
FIG. 5 is a sectional side view of the feeding apparatus 50 according to the present invention.
Figure 6:
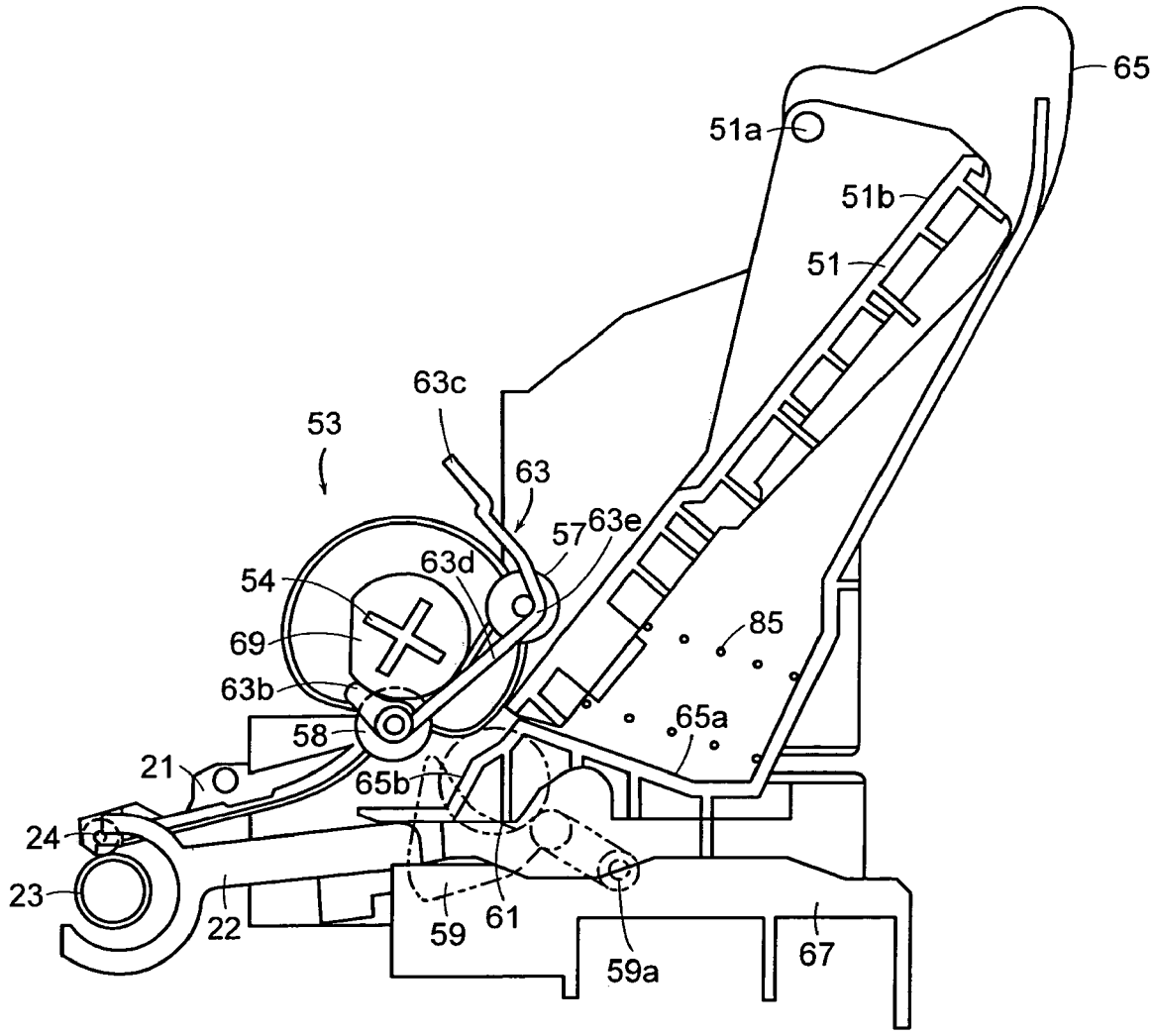
FIG. 6 is a sectional side view of the feeding apparatus 50 according to the present invention.

The narrow means for narrowing a clearance between the feed roller 53 and the hopper 51 will be explained with reference to FIGS. 3–6. FIGS. 3 and 4 show perspective views of the feeding apparatus 50. FIGS. 5 and 6 show sectional side views of the feeding apparatus 50. In FIGS. 3 and 4, each elemental parts is provided to a frame 65 that constructs the basic body of the apparatus, so that the feeding apparatus 50 is mainly constructed. The hopper 51 is provided in inclined attitude to the frame 65 via the pivot axis 51*a* so that the hopper 51 is pivotable. The hopper 51 pivots around the pivot axis 51*a,* so that the lower end of the hopper 51 is in abutting contact with the feed roller 53 or separates from the feed roller 53. The hopper includes a fixing guide 64 and a movable guide 62, which guide the side end of the papers P that are set in inclined attitude at the hopper 51. The movable guide 62 is provided on the hopper 51, operable to slide on the hopper 51 in accordance with the width of the papers P.

An edge supporting face 65*a* and a guide face 65*b* are formed in the frame 65. In this embodiment, the frame 65 serves as a guide member. The edge supporting face 65*a* is opposed to the lower end of the hopper 51, and supports an edge of the set papers P that are set in inclined attitude. In this case, the edge supporting face 65*a* contacts the edge of the papers P. The guide face 65*b* is opposed to the feed roller 53 and the auxiliary roller 55, and guides the fed papers P to the downstream side. In this case, the guide face 65*b* is formed as a top face of the respective rib. Therefore, the edge of the set papers P slips in contact with the edge supporting face 65*a* according to the pivotal movement of the hopper 51, and then passes through an intersection position of the edge supporting face 65*a* and the guide face 65*b,* and next, goes to the downstream side, guided by the guide face 65*b*. As described above, the frame 65 not only constructs the basic body of the feeding apparatus 50, but also performs as a guide member for guiding the papers P in the case of feeding.

In the second states in which the hopper 51 is spaced apart from the feed roller 53 as shown in FIG. 5, the feeding apparatus 50 sets the clearance between the feed roller 53 and the hopper 51 to be wide, in order to prepare as many papers as possible at one action for the convenience when setting papers. However, if the clearance between the hopper 51 and the feed roller 53 is wide, it is feared that the edge of the papers have the tendency of bending when a few paper are set, so that the edge of the papers slips on the surface of the supporting part and then enters into a clearance between the feed roller 53 and a guide face 65*b*. In addition, if the clearance between the hopper 51 and the feed roller 53 become wide, the attitude of the papers P is not constant when the maximum number of the papers P is set or the minimum number of the papers P is set, and consequently the loads caused by transporting each of the papers P is not constant. Therefore it is also desirable to reduce the loads in order to obtain consistent quality of recording.

According to this embodiment, the feeding apparatus 50 includes a narrow means for narrowing the clearance between the feed roller 53 and the hopper 51, in the second state in which the hopper 51 is spaced apart from the feed roller 53. In this embodiment, this narrow means is constructed by the body 63 which extends along the main scanning direction. The body 63 is provided so that a bottom face of the body 63 is opposed to the feeding path and is pivotable in a clockwise direction or in an anticlockwise direction around the pivot axis 63*a*. According to the pivotal movement, the upstream part of the body 63 moves backward and forward to the feeding path. In addition, holes (not shown) are formed at positions where each of the feed roller 53 and the auxiliary roller 55 is located so that the feed roller 53 and the auxiliary roller 55 project beyond the bottom face of the body 63 toward a side of the feeding path as shown in FIG. 6. In addition, according to this embodiment, the center of rotation of the guide roller 58 and the pivot center of the body 63 are provided at the same position.

On the contrary, two cams 69, formed to be substantially D-shaped and disc-shaped, and the feed roller shaft 54 are integrated, and two cam followers 63*b* operable to engage with the cams 69 are formed with the body 63. When each of the flat parts of the cams 69 is opposed to the cam followers 63*b,* the upstream part of the body 63 is displaced downward (the state in FIG. 3 or FIG. 5), whereas when each of the circular arc parts of the cams 69 engages with the cam followers 63*b,* the upstream part of the body 63 is displaced upward (the state in FIG. 4 or FIG. 6), in accordance with the rotation of the feed roller shaft 54, as shown in the difference between FIG. 3 and FIG. 4, and in the difference between FIG. 5 and FIG. 6.

As described above, in the second state in which the hopper 51 is spaced apart from the feed roller 53, if the upstream part of the body 63 is displaced downward, the clearance between the feed roller 53 and the hopper 51 is narrowed. Therefore, even if the clearance between the feed roller 53 and the hopper 51 is set to be wide, it is possible to prevent the avalanche phenomenon which happens when the number of the papers P is a few, and therefore, it is possible to prevent the feeding of multi papers.

In addition, the body 63 includes the guide roller 57 as "a first driven roller" and the guide roller 58 as "a second driven roller" at each of positions where the guide rollers 57 and 58 contacts papers P respectively. Specifically, the guide roller 57 is provided at a corner of the upstream side of the bottom part of the body 67, and the guide roller 58 is provided at a corner of the downstream side of the bottom part of the body 67. Therefore, it is possible to reduce both a frictional resistance on a corner of the body 63 where the papers P have a tendency to contact with the body 63, and the load of transporting. In particular, the transported papers P during the recording always contacts the corner of the downstream side of the bottom part, whereas the transported papers P contacts the corner of the upstream side of the bottom part with weak force or not. Therefore, it is possible to obtain the effect to reduce the frictional resistance at the corner of the downstream side of the bottom part. When using a thick paper, for example coated paper, as the paper P, the thick paper contacts the corner of the downstream side with strong force because of its high rigidity, so that the advantage of reducing the frictional resistance is emphasized.

Moreover, since the guide rollers 56 and 57 are provided near a intersection position of the flat part of the feed roller 53 and the circular arc part of the feed roller 53, the frictional resistance on the corner of the feed roller where the papers P tend to contact, i.e. the intersection position of the flat part and the circular arc part, can be reduced and the load of transporting can be deduced more effectively.

In addition, since the attitude of the papers P changes when the maximum number of the papers is set or the minimum number of the papers is set, the contact conditions at the body 63, the feed roller 53 and the auxiliary roller 55 are variable. Consequently, the consistent quality of recording is not sometimes obtained because of the change of the load of transporting. However, according to this embodiment, it is possible to reduce the variations of the quality. Moreover, in this embodiment, the guide rollers 57 and 58 are provided at a side part of the guide roller 58 along the feed roller shaft 54 (i.e. the right side of the guide roller 58, or a upstream position of the scanning) so that the feed roller 53 is pressed between the guide rollers 57 and 58 as shown in FIG. 4.

Figure 19:
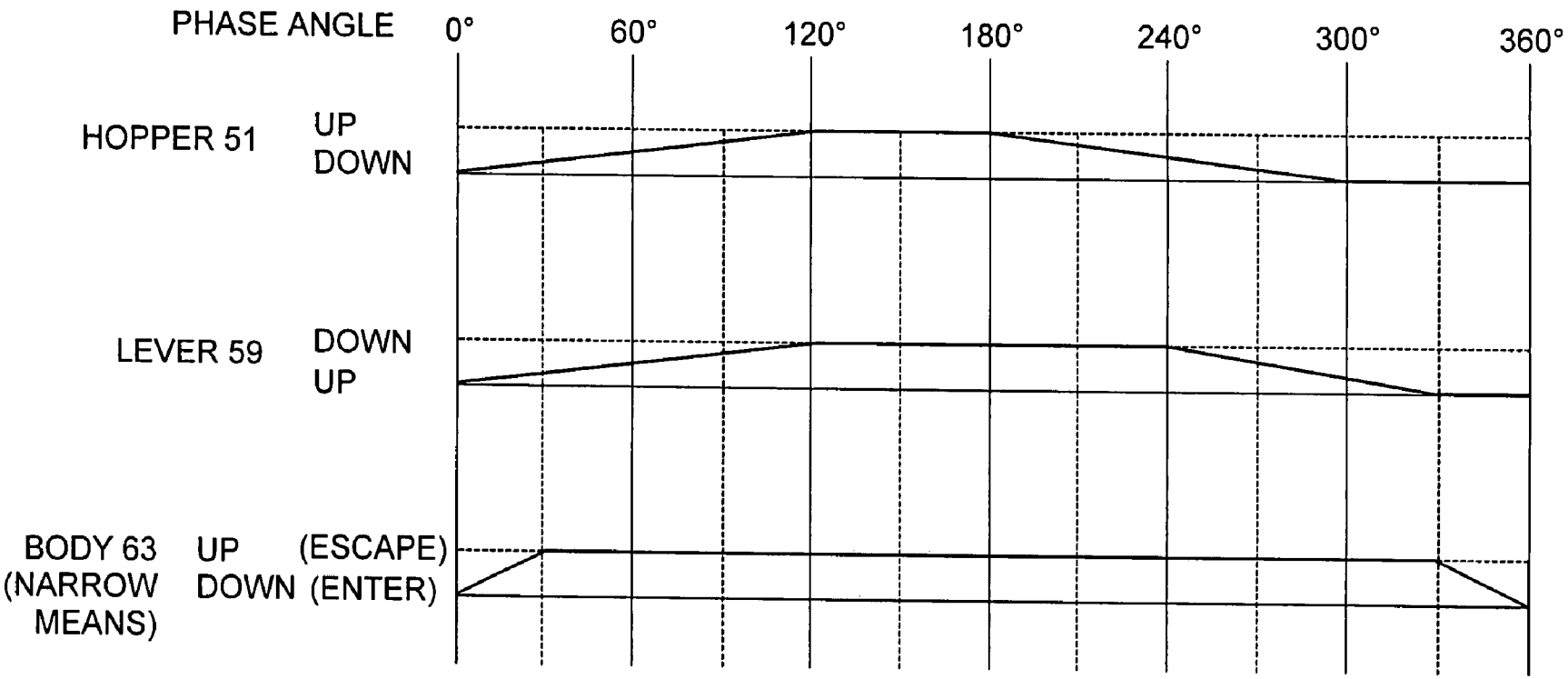
FIG. 19 is a timing chart showing the movement of the feeding apparatus 50.

As described above, the body 63 pivots according to the rotation of the feed roller shaft 54 or the feed roller 53. FIG. 19 is a timing chart showing the phase angle (360 degrees) of the feed roller 53 and each of the operating states of the hopper 51, the lever 59, and the body 63. As shown in FIG. 19, as the feed roller 53 starts to rotate, i.e. as the feed roller 53 starts to feed the paper, the hopper starts to move upward. Once the top paper P is picked up, the hopper 51 starts to move downward. In this case, the narrow means, i.e. the body 63, escapes from the feeding path as the hopper 51 moves upward. When the hopper 51 moves downward and finishes feeding, the body 63 starts to moves toward the feeding path again. Since the body 63 moves in accordance with this series of feeding movement of the one rotation of the feed roller 53, an appropriate feeding movement can be realized without disturbing the moving up by the hopper 51. Moreover, the movement about the lever 59 is described below.

In addition, the narrow means for narrowing the clearance between the hopper 51 and the feed roller 53 in a state in which the hopper 51 is spaced apart from the feed roller 53, may includes any elements not to be limited only the body 63 as described in this embodiment. In other words, the narrow means may includes any elements which is able to prevent the edge of the papers from bending, when a few papers P in inclined attitude are set. Moreover, according to this embodiment, the body 63 includes some advantages as described below. As apparent from the FIGS. 5 and 6, a first guide part 63*c* and a second guide part 63*d* intersect, thereby forming a corner 63*e*. The first guide part 63*c* guides the edge of the papers P to the edge supporting face 65*a* as "an edge supporting part" when the papers P is set. The second guide part 63*d* guides the edge of the papers P to a downstream side of the edge supporting face 65*a*, i.e. the retard roller 61 as "a separation means" when the papers P are fed. At the same time, the body 63 is provided operable to be displaced against the feeding path. Moreover, the guide roller 57 is provided at the upstream side in the second guide part 63*d*, to cover the corner 63*e* with a circumference of the guide roller 57. Thus, the body 63 performs as "a guide member". Therefore, the papers P can be prepared smoothly in the case of setting the papers P due to the first guide part 63*c*, and the papers P also can be transported without fail. Since the corner 63*e* intersected by the first guide part 63*c* and the second guide part 63*d* is covered with the circumference of the guide roller 57, it is possible to feed the papers P to the downstream side smoothly, not causing damage to the surface of the papers P, when the papers are fed.

2-2. The Pivot Axis of the Hopper 51

Figure 7B:
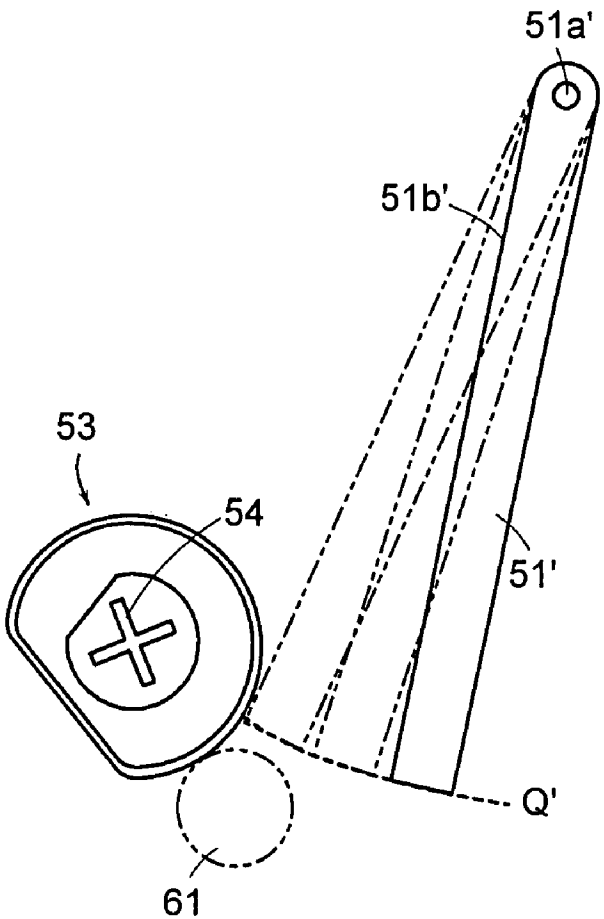
RELATED ART FIG. 7B
FIG. 7B shows a pivotal movement of the hopper 51' according to the related art.
Figure 7A:
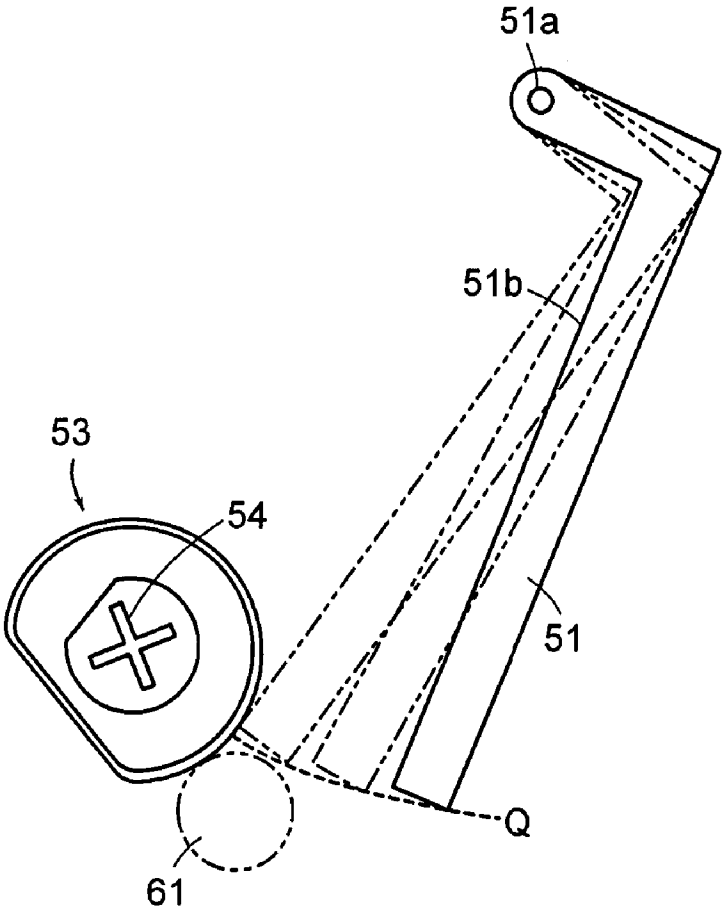
FIG. 7A shows a pivotal movement of the hopper 51 according to the embodiment.
Figure 8:
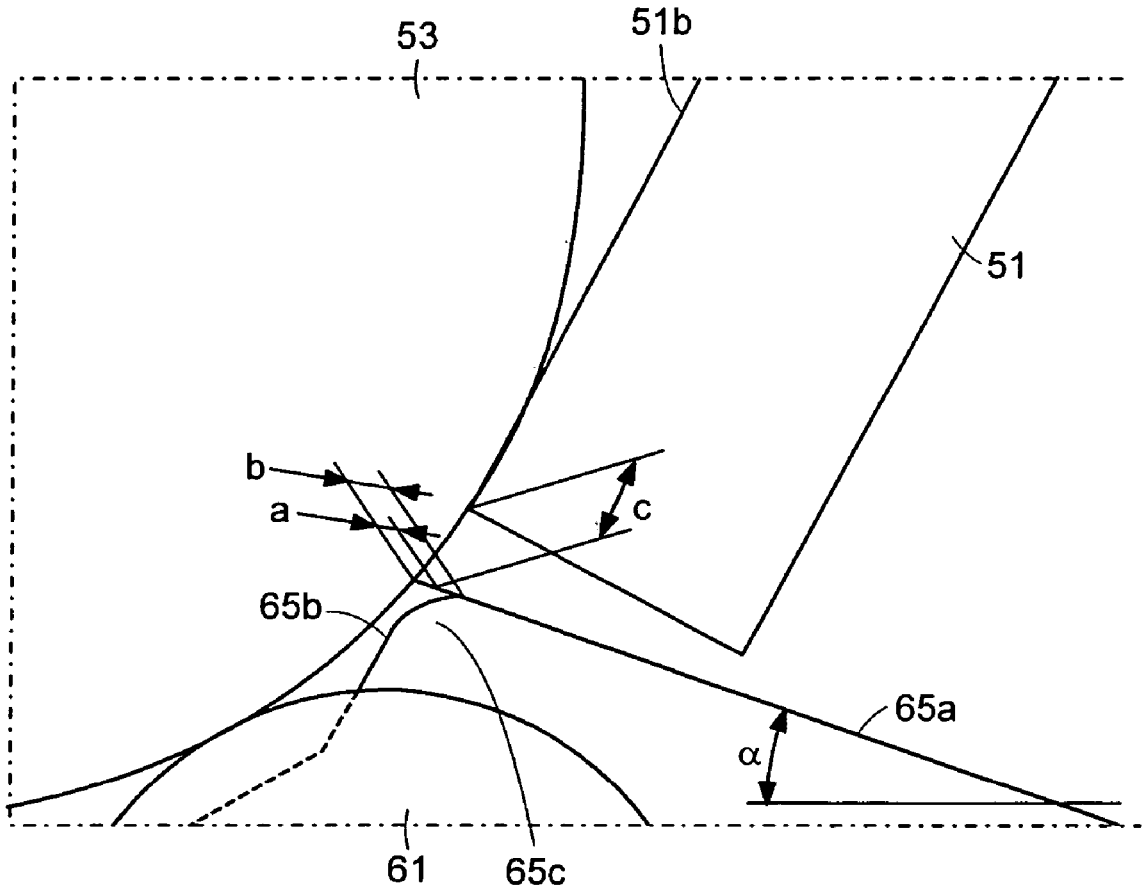
FIG. 8 is a side view, enlarging a position where the hopper 51 and the feed roller 53 are in abutting contact each other.

Next, the pivot axis is explained with reference to FIGS. 7 and 8 mainly, and other drawings if required. FIG. 7A shows the pivotal movement of the hopper 51 according to the embodiment. FIG. 7B shows a pivotal movement of the hopper 51' according to the related art. FIG. 8 is a side view, enlarging a position where the hopper 51 and the feed roller 53 are abutting contacted together.

As apparent from the FIGS. 5 and 6, the papers P is pushed up toward the feed roller 53, slipping in contact with the edge supporting face 65*a* when the hopper 51 pivots. Therefore, when the edge supporting face 65*a* is inclined sharply to the feed roller 53, i.e. an angle $\alpha$ in FIG. 8 is sharp angle, it is difficult to push the set many papers P to be in abutting contact with the feed roller 53. On the contrary, if a force of a hopper spring 85 is changed to be strong in order to overcome this problem, some bad effects are generated, for example a hitting sound when the hopper 51 hits the feed roller 53 becomes more loudly, and a load of a drive motor for driving the cam means for pushing the hopper 51 downward becomes larger. Accordingly, it is desirable that the edge supporting face 65*a* is slightly inclined to the feed roller 53.

On the contrary, since the hopper 51 pivots around the pivot axis 51*a* in order to push the set papers P in contact with feed roller 53, a locus written by the movement when a lower end of the hopper 51 pivots is a circular arc (the arc QQ' in FIG. 7). In this case, the clearance between the lower end of the hopper 51 and the edge supporting face 65*a* becomes wide, and it is feared that the edge of the papers P bends in accordance with the pivoting of the hopper 51, and then enters into the clearance, and consequently a jam happens.

In addition, there is also the following problem. In FIG. 8, clearances a or b is defined as a clearance between an intersection part 65*c* and the feed roller 53, and the intersection part 65*c* is formed by the edge supporting face 65*a* and the guide face 65*b*. In this case, the clearance b is defied as a clearance when the R-shaped part of the intersection part 65*c* is considered. A distance c is defined as a distance between the contacting point formed by both the feed roller 53 and the hopper 51, and the intersection part 65*c*. In the avalanche phenomenon, since the multi papers P has the tendency to be transported as the clearances a and b becomes wider, it is preferable that the clearances a and b are narrow. In addition, if the distance c is long, the edge of the top paper P that is to be fed becomes movable freely between the abutting point and the intersection part 65*c*. Thus, it is feared that the edge of the papers bump into the intersection part 65*c*, and consequently the transporting jam is generated. Accordingly it is preferable that the distance c is short. However, as described above, when the clearance between the lower end of the hopper 51 and the edge supporting face 65*a* becomes wide, the distance c becomes long. Moreover, the distance c also becomes long if the locus (circular arc) written by the lower end of the hopper 51 is not formed to be along the shape of the edge supporting face 65*a*.

Therefore, according to these points of view, it is preferable that the locus written by the lower end of the hopper 51 is substantially formed to be along the shaped of the edge supporting face 65*a*. Here, as described above, it is required that the edge supporting face 65*a* is formed to be slightly circular arc toward the feed roller 53. In order to make the locus of the lower end of the hopper 51 to be along this circular arc, it is required that the hopper 51 is constructed so that the length of the hopper 51 is long, or it is required that the pivot axis 51*a* is provided further upward. However, if such reconstruction is done, the apparatus becomes a larger one.

Thus, according to this embodiment, the pivot axis 51*a* of the hopper 51 is located at a side of the feed roller 53 with respect to the supporting face 51*b* which supports the papers P. More specifically, according to this embodiment, the pivot axis 51*a* is located near a plate that is formed by the top paper when the maximum number of the papers P is set. The detailed explanation is described below. Since the pivot axis 51*a'* of the hopper 51' according to the related art was located near the supporting face 51*b'* as shown in FIG. 7B, if the hopper 51' was constructed to be short in order to construct the apparatus to be small, the locus Q' written by a lower end of the hopper 51' was inclined sharply to the feed roller 53.

On the contrary, according to this embodiment, the pivot axis 51*a* is shifted to the side of the feed roller 53 with respect to the supporting face 51*b* which supports the papers P, so that the locus of the lower end of the hopper 51 is formed to be slightly circular arc toward the feed roller 53 (circular arc Q) as shown in FIG. 7A. Therefore, although the edge supporting face 65*a* is formed to be slightly circular arc, the locus of the lower end of the hopper 51 is formed to be along this arc, so that the clearance between the lower end of the hopper 51 and the edge supporting face 65*a* becomes small. Accordingly, the edge of the papers P does not enter into the clearance between the lower end of the hopper 51 and the edge supporting face 65*a* when the hopper 51 pivots, and consequently the feeding papers can be realized appropriately. In addition, since the distance c in FIG. 8 can be short, the feeding papers can be also realized appropriately. Moreover, in the configuration shown in FIG. 7B, the distance c was about 1.2 mm where the length of the hopper was 92 mm to 93 mm, whereas the distance c was about 0.4 mm due to shifting the pivot axis to the side of the feed roller 53 as shown in FIG. 7A. The extensive improvement to short the distance c was realized.

Moreover, according to this embodiment, the pivot axis 51*a* is located near the plate of the top paper when the maximum number of the papers P is set. Since the pivot axis 51*a* does not separate from the supporting face 51*b* beyond necessity, the apparatus does not become bigger, and at the same time, the lower end of the hopper 51 can be in contact with the feed roller 53 reliably.

2-3. The Cam Means for Pivoting the Hopper 51.

Figure 9:
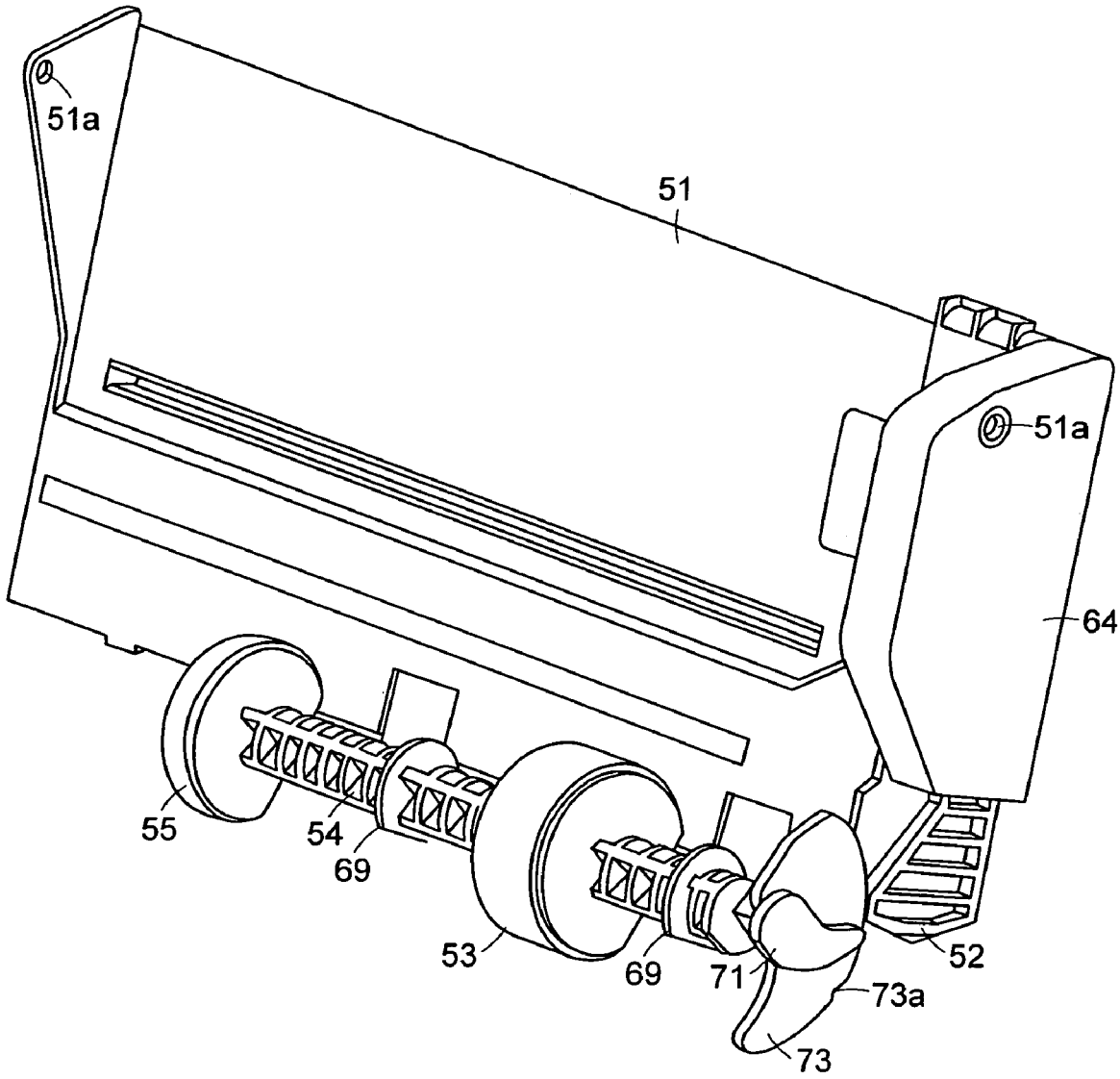
FIG. 9 is a perspective view of a cam means.
Figure 10A:
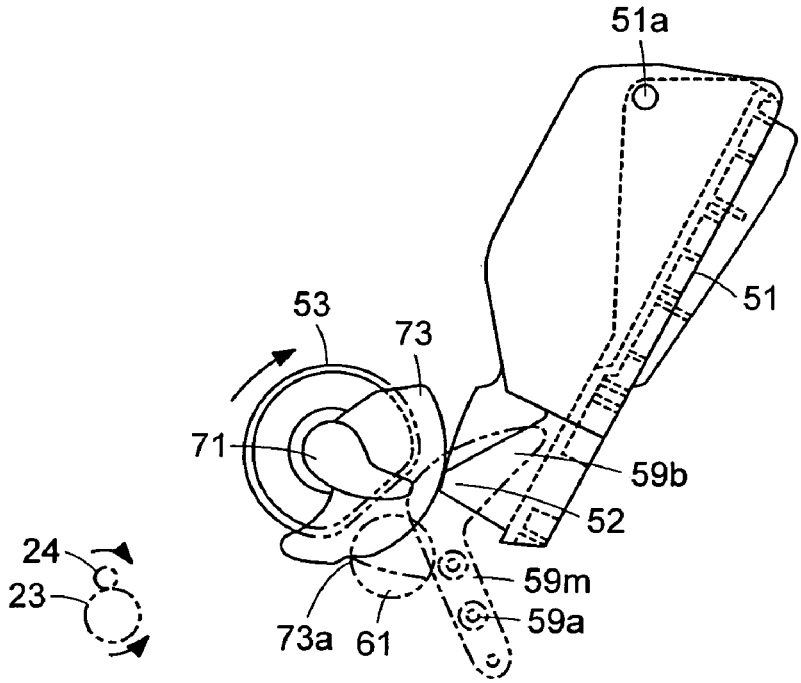
FIG. 10A is a front views of the cam means.
Figure 10B:
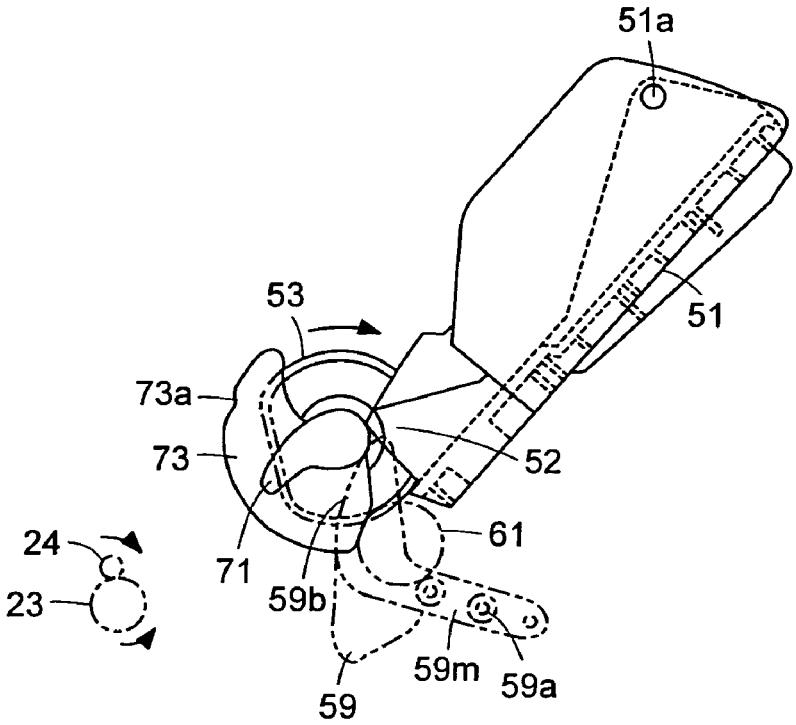
FIG. 10B is a front views of the cam means.
Figure 10C:
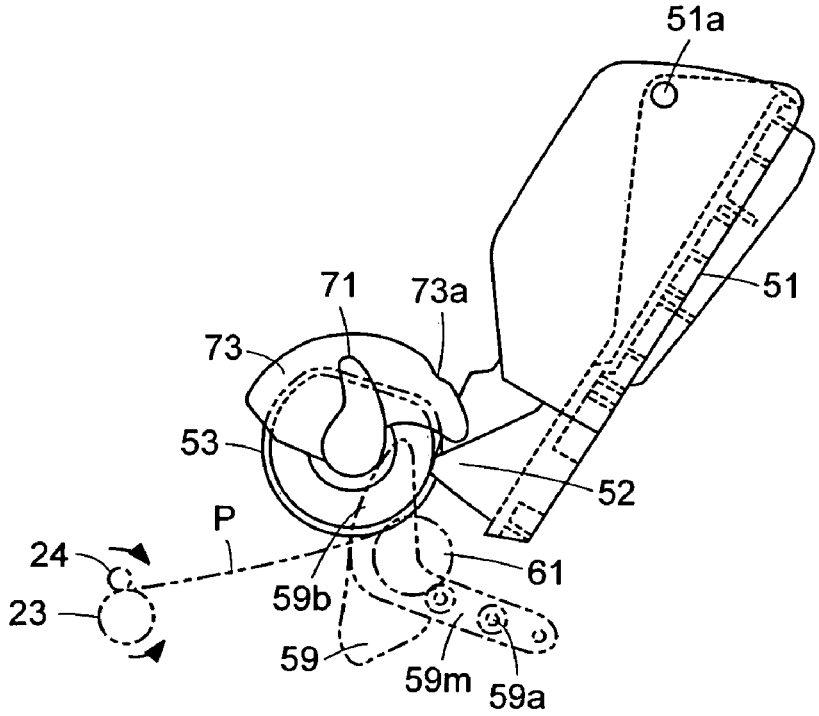
FIG. 10C is a front views of the cam means.
Figure 10D:
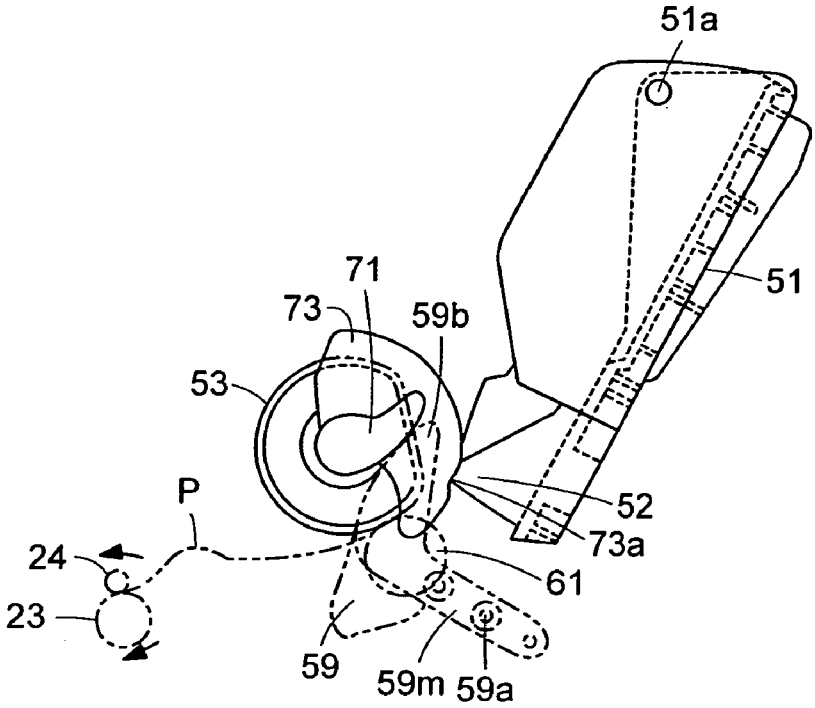
FIG. 10D is a front views of the cam means.

Next, the cam means for pivoting the hopper 51 is explained with reference to FIGS. 9 to 10D, and other drawings. FIG. 9 shows a perspective view of the cam means, i.e. the hopper 51 and the feed roller shaft 54. FIGS. 10A to 10D show front views of the cam means, i.e. the side views of the hopper 51. As shown in FIG. 9, the hopper 51 includes the fixing guide 64 at the right side of the drawing and the cam follower 52 at the bottom part of the fixing guide 64. On the contrary, the feed roller shaft 54 extends along a direction from the right side (near the starting position of the scanning of the recording head 29) to the middle part of the hopper 51. The auxiliary roller 55 is formed with the feed roller shaft 54 integrally at the left side (near the ending position of the scanning of the recording head 29) and the feed roller 53 is formed with the feed roller shaft 54 integrally at the right side (near the starting position of the scanning of the recording head 29). The auxiliary roller 55 and the feed roller 53 have almost the same shape. The auxiliary roller 55 performs to adjust the attitude of the fed paper P uniformly with respect to the width direction. Since the feed roller 53 is located toward the right side in order to accept different paper sizes, when the used paper is wide one, if the auxiliary roller 55 is not provided, a part of the paper is bent at a position corresponding to the feed roller 53 in particular, and the other parts of the paper is not so bent, and consequently the paper is recorded in inclined attitude.

A cam 73 is formed with the feed roller shaft 54 with integral molding at the feed roller shaft 54 near the right side across the cam follower 52. In this case, the cam 72 has a shape that is operable to engage with the cam follower 52. Thus, in the case in which the feed roller shaft 54 rotates, the cam 73 pushes down the cam follower 52 against a force of the hopper spring 85 (see FIGS. 5 and 6) that urges the hopper 51 a against the feed roller 53, so that the hopper 51 is spaced apart from the feed roller 53. In addition, the hopper spring 85 is an example of the urging means. In the case in which the engagement between the cam 73 and the cam follower 52 is released, the hopper 51 is in abutting contact with the feed roller 53 due to the force of the hopper spring 85.

Here, when the papers P is fed from the feeding apparatus 50, it is feared that the paper is fed in inclined attitude (i.e., skew of the paper). Therefore, in the printer 1, the movement for canceling the skew is executed. There are many methods for canceling this skew. According to an example of the methods, when the edge of the paper P moves to the downstream side with a predetermined distance from a nipping point between the transport driving roller 23 and the transport driven roller 24, the rotation of the feed roller 53 is stopped. Next, as shown in FIG. 10D, the transport driving roller 23 is driven in an inverse direction, keeping the states of nipping of the paper P by the feed roller 53 and the retard roller 61. Then, the edge of the paper moves back to the upstream side. At the same time, the upstream of the paper is restricted by the feed roller 53 and the retard roller 61, so that the edge of the paper bends, and then, bumps into the nipping point. Therefore, the skew is canceled.

When trying to cancel the skew, if a technical paper having a thick coated layer is used as the paper P, it is feared that the technical paper does not bend at the path between the transport driving roller 23 and the feed roller 53, but the technical paper moves back to the upstream side in accordance with the inverse rotation of the transport driving roller 23 because of its high rigidity.

Figure 12:
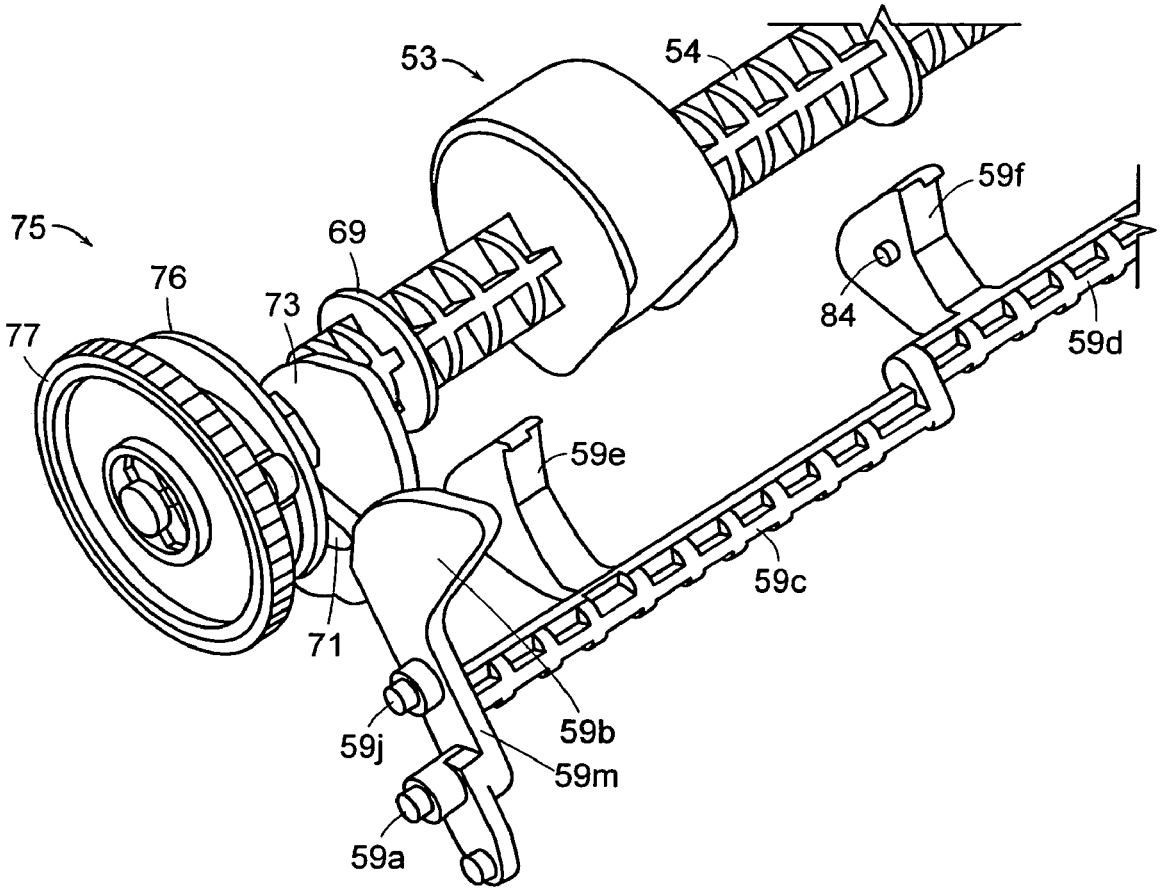
FIG. 12 is a perspective view of a returning lever cam means for driving the lever 59.

In the FIG. 12, a conveyed disc 76 is formed with the 54 integrally. The conveyed disc 76 receives conveyance of power selectively via the clutch equipment 75 from the transfer gear 77 that is always driven to rotate by a drive motor (not shown) The clutch equipment 75 is constructed so that the power is conveyed in accordance with only one rotation direction of the transfer gear 77, i.e. the clutch equipment 75 is so-called one-way clutch equipment. Accordingly, if the paper P moves back to the upstream side as described above in the case of canceling the skew, the clutch equipment 75 allows the feed roller 53 to rotate in inverse direction, i.e., an inverse direction in case of feeding the papers. Consequently, the feed roller 53 rotates in inverse direction in accordance with the movement of the paper P, and it is feared that the feeding of the next paper is not executed correctly.

Specifically, as explained with reference to the FIG. 19, the series of the feeding movement are constructed so that the hopper 51 and the lever 59 operates in association with the phase angle of the feed roller 53. Therefore, if the feed roller 53 rotates in inverse direction and the relationship of the phase angle is out of order, the correct feeding movement is not executed. Moreover, since the feeding movement has stopped before one complete rotation of the feed roller 53 finishes, it is feared that the recording operation starts in a state in which the paper P is being pressed between the feed roller 53 and the retard roller 61. Thus, a significant load of transporting is generated. According to this, there is also a problem that the quality of the recorded paper is not fine.

According to this embodiment, the cam means constructed by the cam 73 and the cam follower 52 includes a holding means for holding the engagement between the cam 73 and the cam follower 52, not to be changed, i.e. holding the feed roller shaft 54 not to rotate. The holding means is constructed so that a concave part 73*a* is provided at the circumference of the cam 73 and a convex shaped part at the cam follower 52 fits this concave part 73*a*, thereby holding the engagement between the cam 73 and the cam follower 52 as shown in FIGS. 10A–10D. Specifically, in the stand-by state in FIG. 10A when the feeding movement starting, the cam follower 52 is release from the circumference of the cam 73 as shown in FIG. 10B and then the hopper 51 comes close to the feed roller 53. Next, the cam 73 pushes the cam follower 52 downward again as shown in FIG. 10C and then, the state goes back the state in FIG. 10A and the one-cycle of the feeding movement is finished. While the feeding movement goes back to the state in FIG. 10A, the mentioned-above canceling the skew is executed.

In the case of canceling the skew, the transport driving roller 23 rotates in inverse direction with the feed roller 53 being stopped as described above. Specifically, the movement of canceling the skew is executed with the convex shaped part of the cam follower 52 fitting to the concave part 73*a* and with the feed roller 53 being stopped. Therefore, it is possible to realize a state in which the feed roller shaft 54 is hard to rotate, i.e. a state in which the feed roller shaft 54 is substantially locked. Accordingly, it is possible to bend the paper P without fail when the transport driving roller 23 rotates in inverse direction even if the rigidity of the paper P is high. Thus, it is possible to execute the canceling of the skew without fail. In addition, since the feed roller 53 does not finish its feeding movement before the complete one rotation of the feed roller 53 is done, it is possible to execute the appropriate feeding movement according to the phase angle of the feed roller 53 and it is also possible to obtain a fine recorded paper because such a trouble that the recoding movement is executed with the paper P being pressed between the feed roller 53 and the retard roller 61 does not occur.

2-4. The Lever 59

Figure 11:
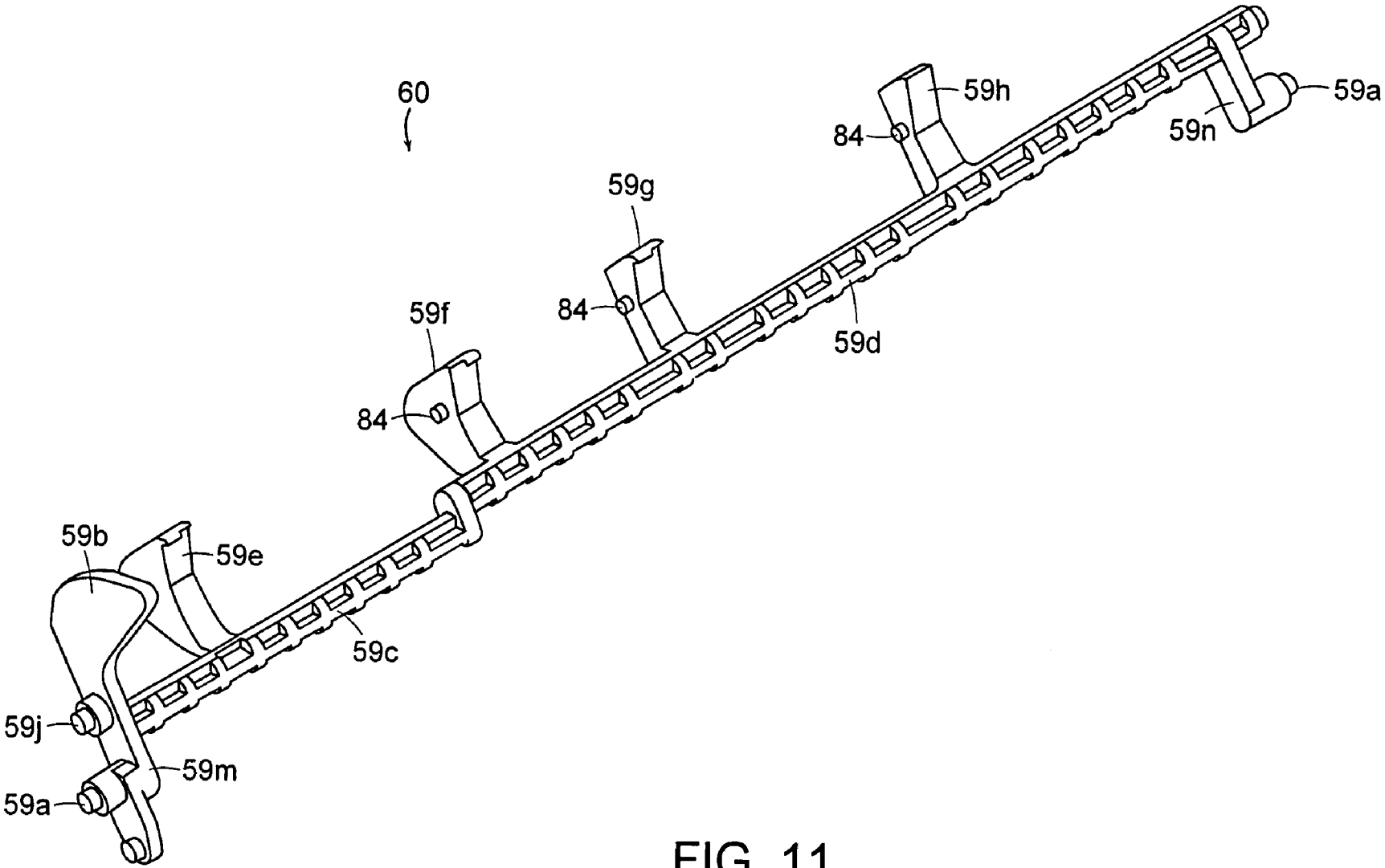
FIG. 11 is a perspective view of a lever 59.
Figure 13:
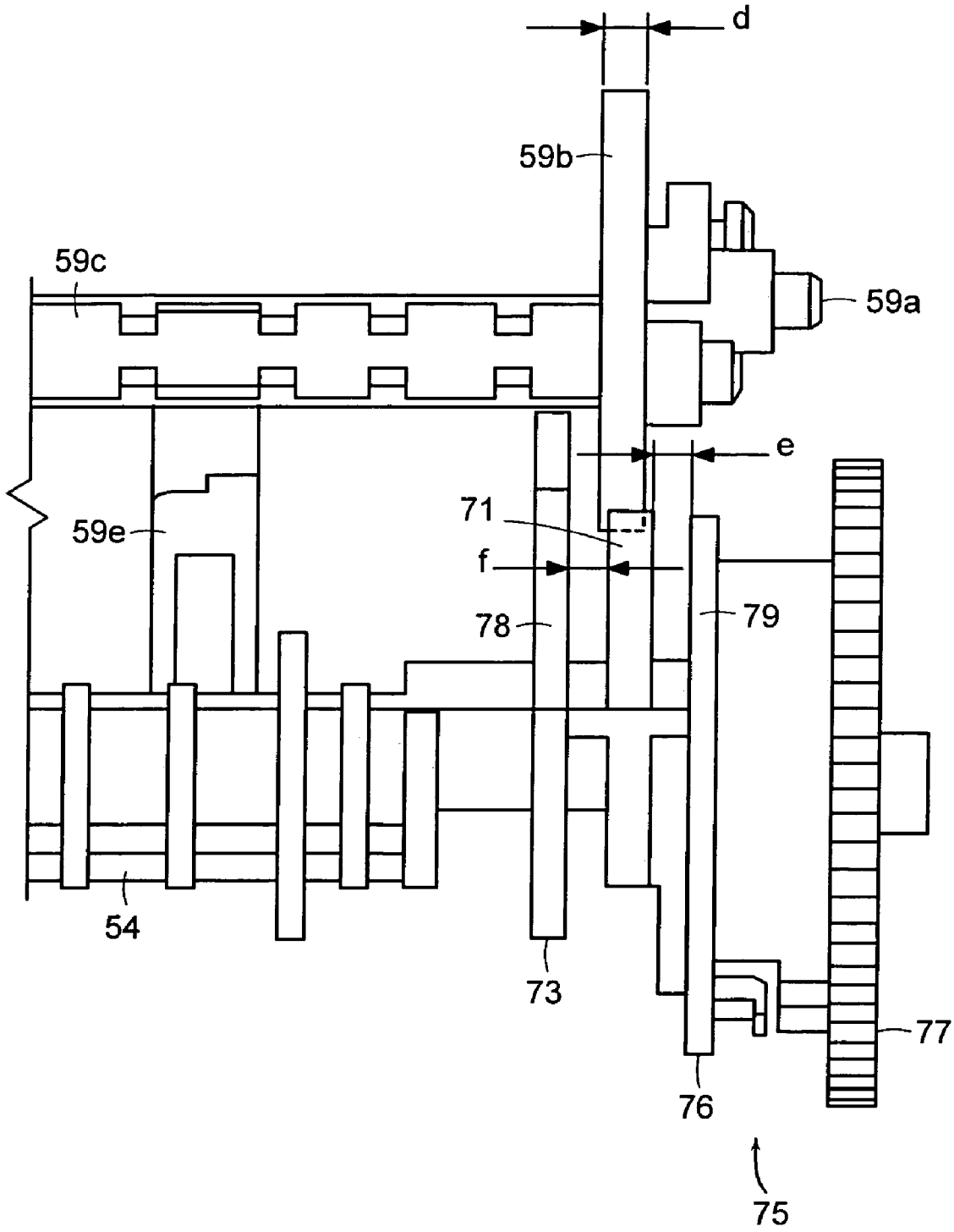
FIG. 13 is a plane view of the returning lever cam means.
Figure 15:
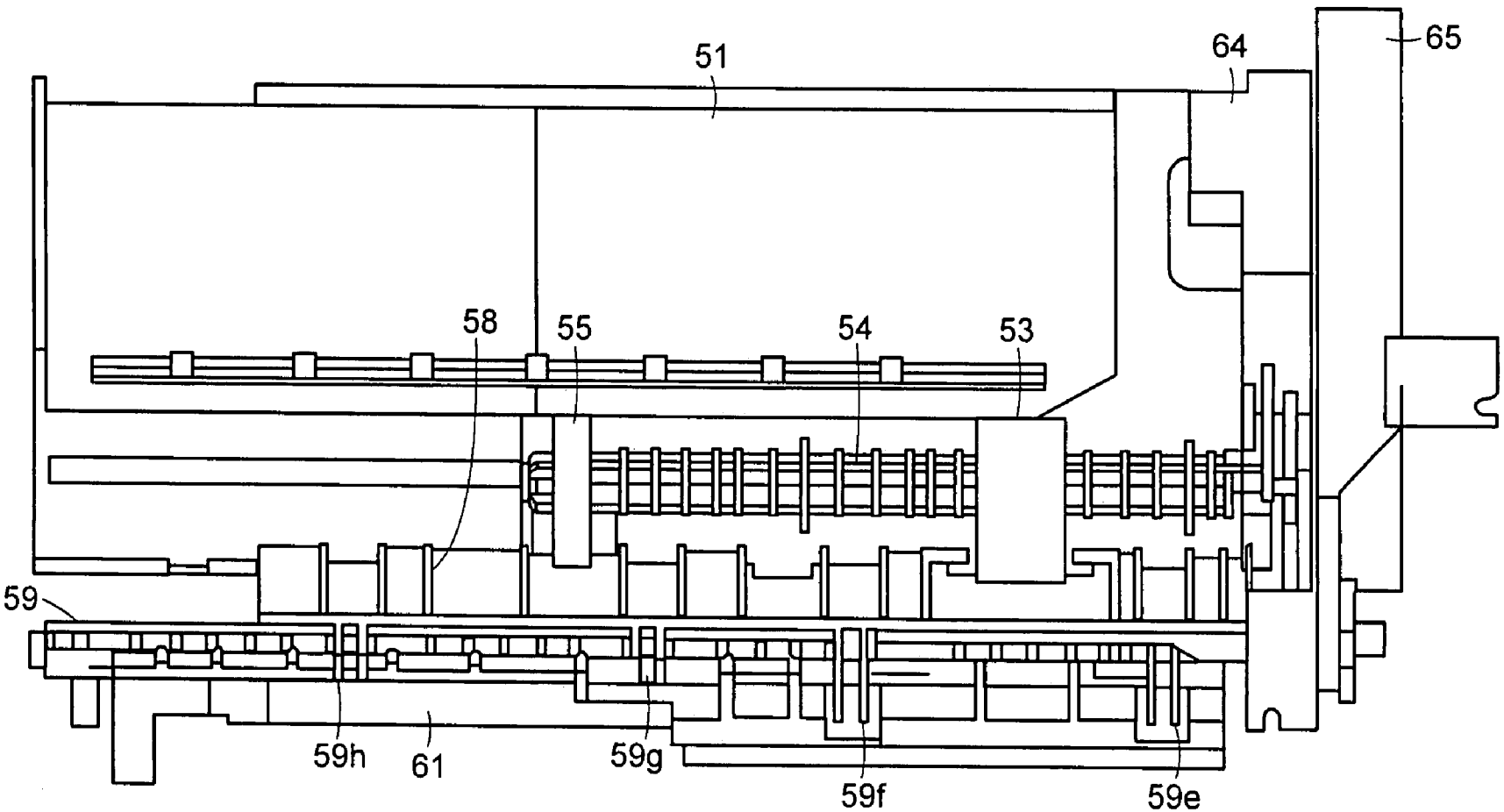
FIG. 15 is a front view of the feeding apparatus 50.
Figure 16:
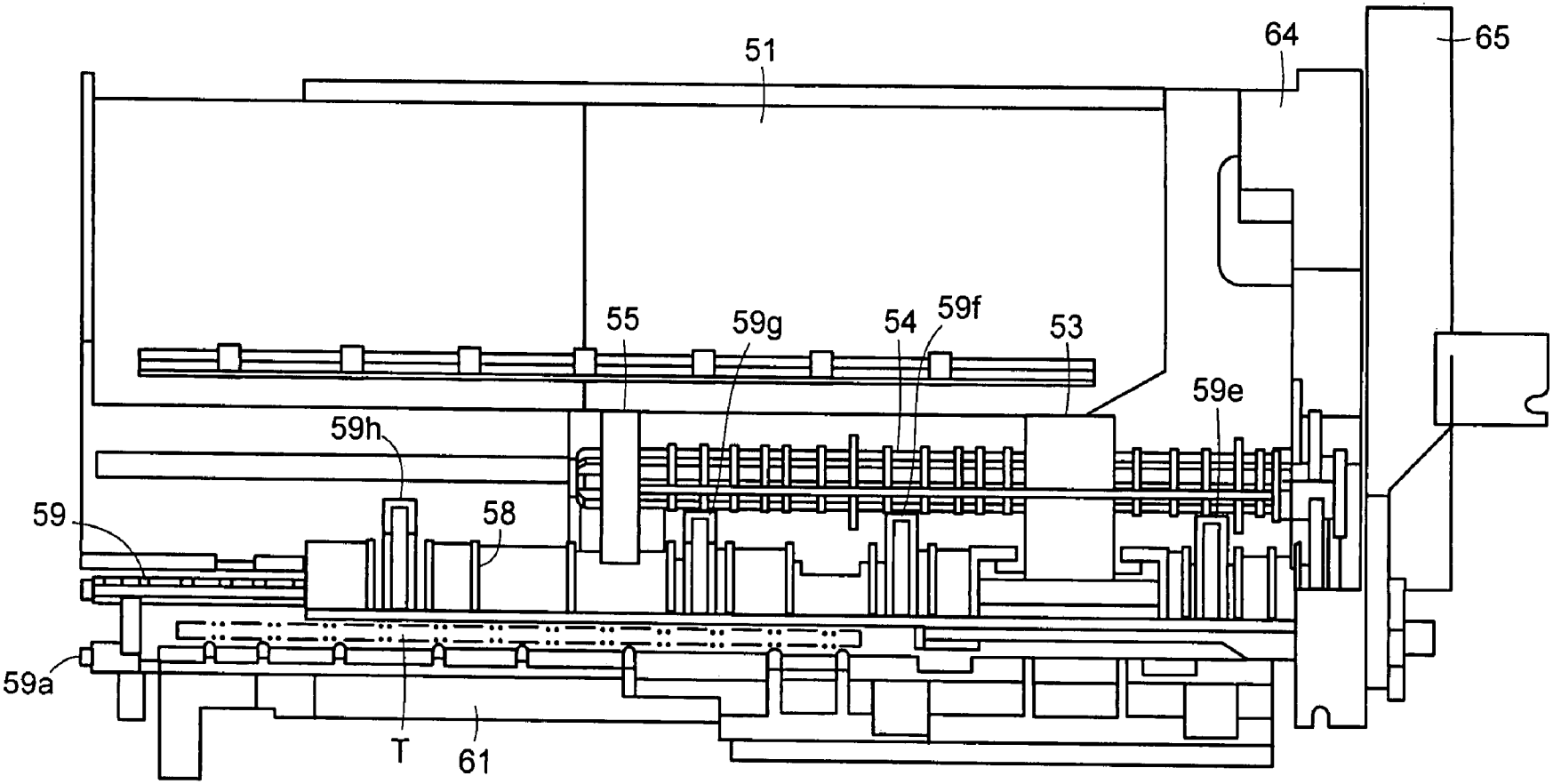
FIG. 16 is a front view of the feeding apparatus 50.
Figure 17A:
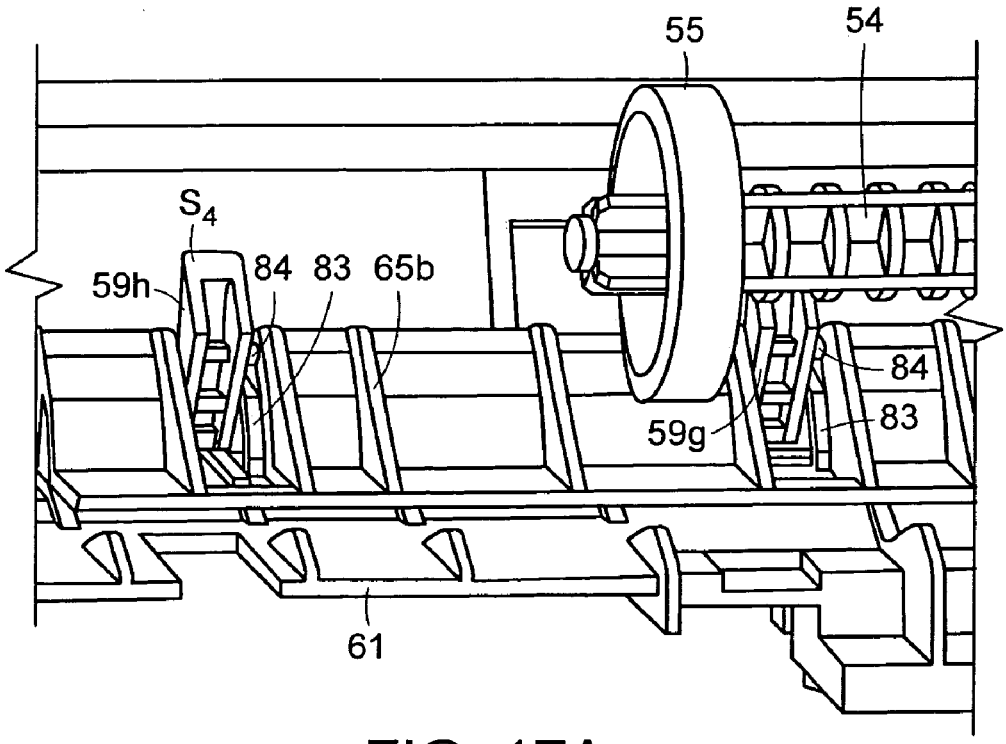
FIG. 17A shows a partially enlarged perspective view of the feeding apparatus 50.
Figure 17B:
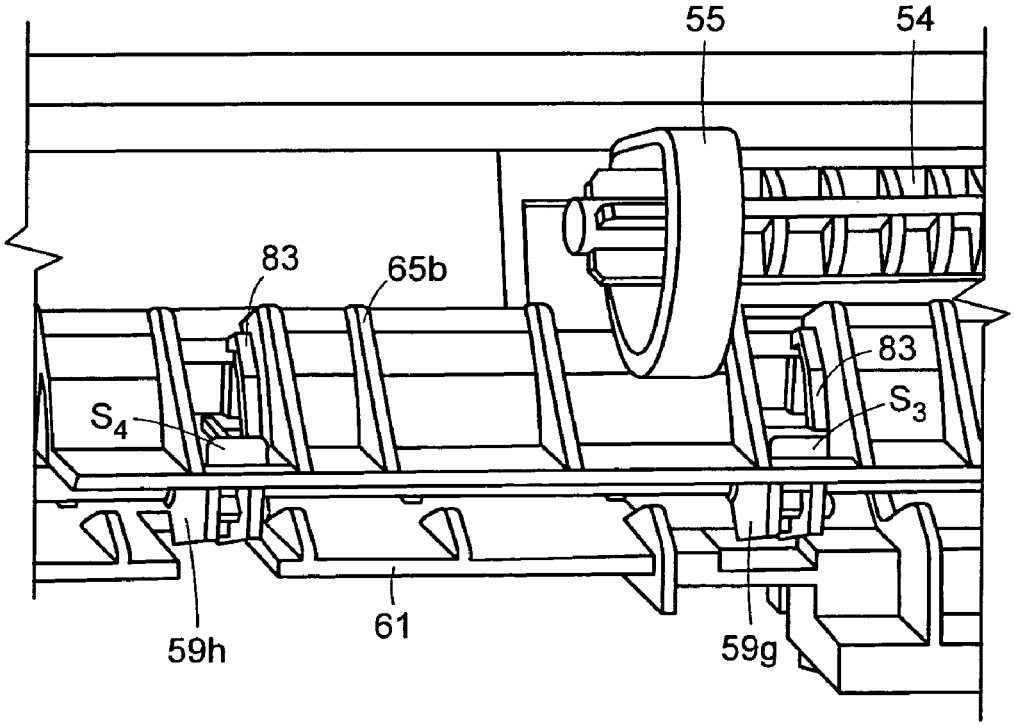
FIG. 17B shows a partially enlarged perspective view of the feeding apparatus 50.

Next, the lever 59 will be explained with reference to FIGS. 11–18 and other drawings if required. FIG. 11 shows a perspective view of the lever 59 and a shaft body 60. FIG. 12 shows a perspective view of a returning lever cam means for driving the lever 59. FIG. 13 is a plane view of the returning lever cam means. FIG. 14 shows a perspective view of a lever 59 according to another embodiment. FIGS. 15 and 16 show a front view of the feeding apparatus 50. FIG. 17 shows a partially enlarged perspective view of the feeding apparatus 50. FIG. 18 shows a schematic view of the lever 59 and the feed roller 53 seen from the front.

The lever 59 is provided so that a rotational region of the lever 59 is overlapped with the nipping point of the feed roller 53 and the retard roller 61, when seen from the side view of the feeding path of the paper P (see FIGS. 5 and 6). The lever 59 performs to return the following papers next to the top paper back to the upstream side, i.e. back to the hopper 51.

The lever 59 includes a plurality of returning levers 59*e*, 59*f*, 59*g* and 59*h*. The returning levers 59*e*–59*h* are provided at the shaft body 60 in a predetermined interval along the width direction of the papers. The shaft body 60 includes a shaft 59*c*, a shaft 59*d* and two arm parts 59*m* and 59*n*. The shaft 59*c* extends along the width direction of the papers as shown in FIG. 11. The shaft 59*d* extends along the width direction of the papers similar to the shaft 59*c*, and includes an axis located at a position that is different from a position of an axis of the shaft 59*d*. The shaft body 60 is formed by the shaft 59*c* and shaft 59*d* to be crank-shaped. Each of the arm parts 59*m* and 59*n* is provided at each end part of the shaft body 60 and extends vertical to the shafts 59*c* and 59*d* respectively. The returning levers 59*e*, 59*f*, 59*g* and 59*h* may be called "the lever 59" hereinafter.

The shaft body 60 includes two rotational axis 59*a* and 59*b*, which are formed to be projected at each of the end parts of the shaft body 60. A cam follower 59*b* is formed to be lever-shaped at one edge part of the shaft body 60. Each of the returning levers 59*e*, 59*f*, 59*g* and 59*h* includes a boss 84 that projects in the width direction of the paper. In this embodiment, all elements which construct the shaft body 60 are manufactured integrally from resin and the shaft body 60 is provided to the frame 65 (see FIG. 3) so that the shaft body 60 is operable to rotate around the two rotational axis 59*a*.

The returning cam means for rotating the lever 59 will be explained. As shown in FIG. 9, a cam 71 is provided near the cam 73 that pivots the hopper 51 around the feed roller shaft 54, and this cam 71 is fitted to the cam follower 59*b* provided at the shaft body 60 as shown in FIG. 12. On the contrary, the shaft body 60 is forced by a coil spring (not shown) so that the each of the retuning levers 59*e*–59*h* falls in the downstream direction. The shaft body 60 is driven to pivot by the retuning cam means that is constructed by the cam 71 and the cam follower 59*b*, and the coil spring, so that the shaft body 60 has a state in which the lever 59 arises to the upstream side as shown in FIG. 5 or a state in which the lever 59 falls to the downstream side as shown in FIG. 6.

The movement of the lever 59 will be explained more specifically. As shown in FIG. 19, in a waiting state of feeding papers, the lever 59 arise, i.e. the lever 59 blocks the feeding path (see FIG. 10A). As the feeding papers starts, the lever 59 falls down to the downstream side, and moves from the feeding path to make a space (see FIG. 10B). After the starting of the moving down of the hopper 51, the lever 59 arises to the upstream side and then, returns the following papers of the top papers back, which the following papers is going to transport in accordance with the transportation of the top paper (see FIG. 10D).

If the lever 59 rotates to the upstream side with many papers P are at the nipping position of the feed roller 53 and the retard roller 61, it is feared that the lever 59 and the guide face 65*b* (see FIG. 5) sandwich the edge of the papers, thereby occurring a jam and generating an excessive load to the lever 59. In this case, it is feared that the cam follower 59*b* is released from the cam 71 because of the strong pressure between the cam 71 and the cam follower 59*b*. Thus, according to this embodiment, the cam 71 and the conveyed disc 76 are provided at each side of the cam 71 as shown in FIG. 13, and constructed so that the cam follower 59*b* is not released from the cam 71.

More specifically, when the cam 71 is sandwiched between the cam 73 and the conveyed disc 76, a clearance f is formed at a side of the cam 71 and a clearance e is formed at a side of the conveyed disc 76. In addition, in this embodiment, it is constructed so that the width d of the cam follower 59*b* that fits to the cam 71 is wider than the clearance f and the clearance e, and also it is constructed so that a circumference of the cam follower 59*b* is always located between the cam 73 and the conveyed disc 76. Therefore, even if the cam follower 59*b* is going to be released from the cam 71, the cam 73 and the conveyed disc 76 which are adjacent to the cam follower 59*b* restrict this phenomenon, so that the engagement between the cam 71 and the cam follower 59*b* is always kept.

Figure 14A:
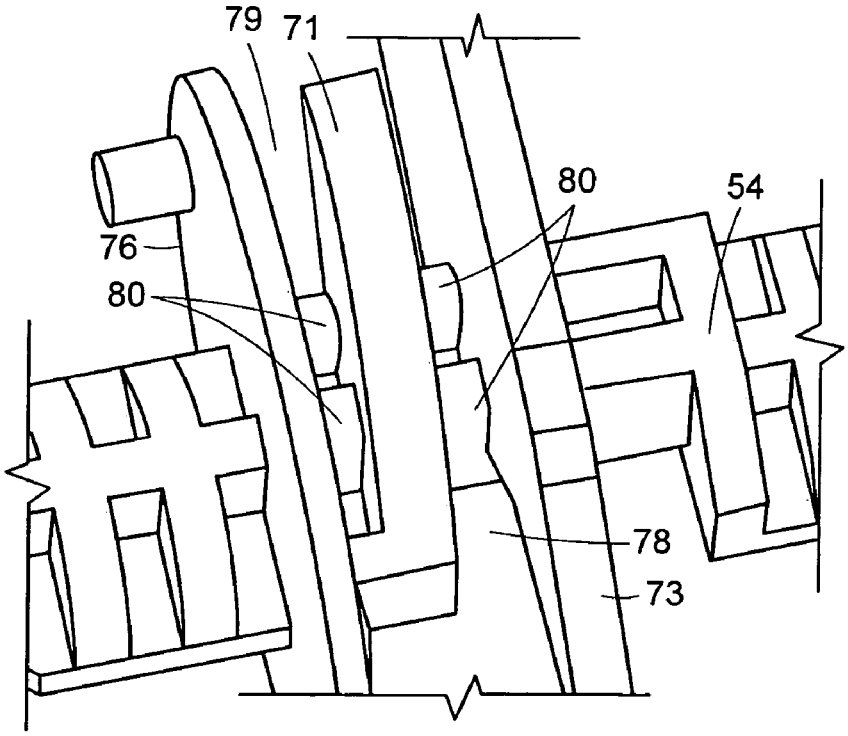
FIG. 14A is a perspective view of the lever 59 according to another embodiment.

In addition, another embodiment may be constructed as shown in FIG. 14. According to an embodiment in FIG. 14A, the feed roller shaft 54 forms R-shaped parts 80 that are provided between the cam 71 and the cam 73, and between the cam 71 and the conveyed disc 76. The reason why the cam follower 59*b* is release from the cam 71 is that the shafts 59*c* and 59*d* are deformed because of the load on the lever 59. Thus, when the load is eliminated, the shafts 59*c* and 59*d* return their primary shapes, and consequently, the engagement between the cam follower 59*b* and the cam 71 returns according to the rotation of the cam 71. However, when the cam follower 59*b* falls into a space between the cam 71 and the cam 73, or a space between the cam 71 and the conveyed disc 76, if the feed roller shaft 54 includes a corner, the cam follower 59*b* is trapped by the corner, and then, both the cam follower 59*b* and the feed roller shaft 54 loose their capability of rotation. According to these points of view, due to forming the R-shaped part, the cam follower 59*b* is not trapped by the feed roller shaft 54, so that the engagement between the cam 71 and the cam follower 59*b* can return in a time.

Figure 14B:
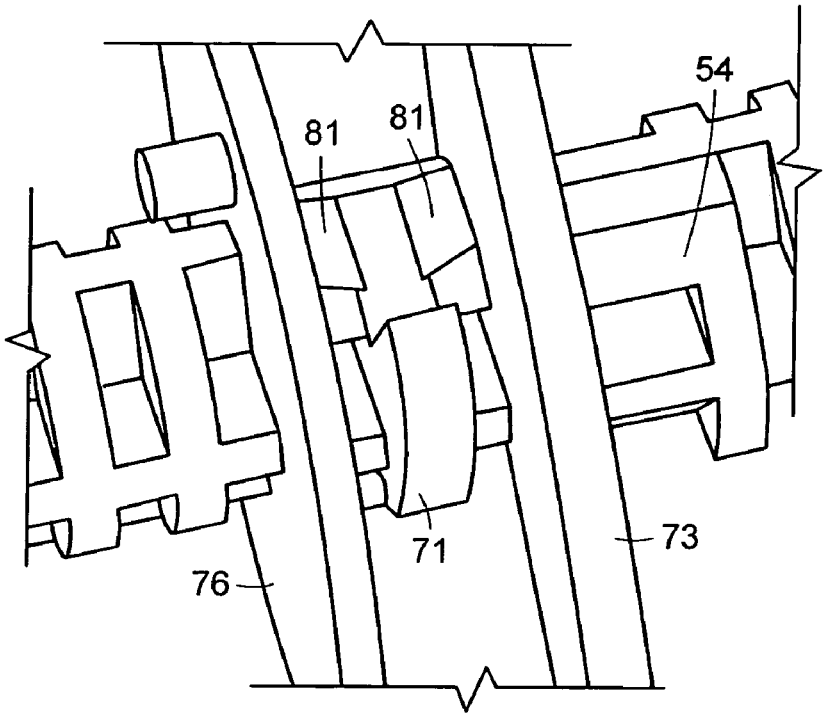
FIG. 14B is a perspective view of the lever 59 according to another embodiment.

Alternatively, another embodiment may also be constructed as shown in FIG. 14B. According to an embodiment in FIG. 14B, the feed roller shaft 54 forms inclined planes 81 that are toward to the cam 71 and are provided between the cam 71 and the cam 73, and between the cam 71 and the conveyed disc 76. Due to so-called "an invitation-shape", even if the cam follower 59*b* is released from the cam 71, the cam follower 59*b* is invited to the cam 71 along the inline plate 81, so that the engagement between the cam follower 59*b* and the cam 71 can return according to the rotation of the cam 71.

The details about the retuning lever cam means for rotating the lever 59 are described above. Next, the effect of the shaft body 60 including the crank-shaped structure is explained. The printer 1 includes two feeding paths described above. The first feeding path includes a curved path, through which the paper P fed from the hopper 51 by the feed roller 53 passes. The second feeding path is liner not having a curved part, through which the paper P passes.

In FIG. 2, the tray T in which the optical disc is set is inserted from the upstream side of the transport driving roller 23 and the transport driven roller 24, i.e. the left side in FIG. 2. Then the tray T is aligned to a starting position of the recording by the rotation of the transport driving roller 23, and is transported to the recording head 29. In this case, the edge of the tray T moving from the transport driving roller 23 to the upstream side, pushes down a guide 22, goes under the feed roller 53, and passes between the guide 67 and the guide member 65 (FIGS. 5 and 6). The guide 22 is provided so that the guide 22 is pivotable around a shaft of the transport driving roller 23 as the pivot axis and is projected to the feeding path.

When the second feeding path is provided, the lever 59 tends to be an obstacle. Since the lever 59 is required to be provided near the feed roller 53 operable to pivot around the rotational axis 59*a*, this rotational axis 59*a* tends to become the obstacle against the second feeding path. In order to prevent this problem, the rotational axis 59*a* is required to be provided at a bottom side of the second feeding path. But, in this case, such a disadvantage that the apparatus becomes bigger is generated.

Thus, according to this embodiment, the lever 59 is provided at the crank-shaped shaft body 60 so that the lever 59 blocks the second feeding path when the lever 59 pivots in a direction to make a space in the first feeding path, and so that the lever 59 makes a space in the second feeding path when the lever 59 pivots in a direction to return the paper P to the upstream side. Since the shaft body 60 is crank-shaped, when the shaft body 60 pivots around the rotational axis 59*a*, the shafts 59*c* and 59*d* form arch-shape as apparent in FIG. 11. Accordingly, although the two rotational axis 59*a* is on the second feeding path when seen from a side view (see FIG. 5), the mentioned-above arch-shape makes a space in the second feeding path as shown in FIGS. 15 and 16.

In other words, the second feeding path is blocked in a feeding state in which the lever 59 falls toward the downstream side in FIG. 15, whereas the second feeding path is opened in a waiting state in which the lever 59 arises toward the upstream side in FIG. 16, so that it is possible to transport the tray T. As described above, it is possible to provide the first feeding path and the second feeding path without the apparatus getting bigger. In addition, a length of the lever 59 from the pivot axis becomes short due to its crank-shape, so that the rigidity of the lever 59 can be high and therefore, the breakdown of the lever 59 can be prevented.

Moreover, the following effects can work. In this embodiment, the tray T is inserted from the upstream side, guided by the tray guide 18 (see FIG. 18). For example, even if the tray T is inserted from the downstream side in failure when the papers P are fed from the hopper 51, since the lever 59 and the shafts 59*c* are blocking the second feeding path, so that the edge of the tray T contacts the lever 59 and the shafts 59*c*. Therefore, it is possible to prevent the failure of the inserting of the tray T.

By the way, according to this embodiment, since the shaft body 60 is made of resin, the shaft body 60 has the tendency to bend. When the shafts 59*c* and 59*d* bend notably, the nipping point of the feed roller 53 and the retard roller 61 deviates from the rotational region, the lever 59 may not return the following papers P being driven by the top paper. Thus, according to this embodiment, a bend restricting means is provided in order to restrict the bend of the shaft body 60.

The bend restricting means includes a plurality of bosses 84, and a restricting part 83. Each of the bosses 84 is provided at the side face of the lever 59 as shown in FIG. 17. The restricting part 83 is formed along a locus written by the bosses 84 in accordance with the rotation of the lever 59 as shown in FIG. 17. The restricting part 83 is formed at a side face of a rib that constructs the guide face 65*a* in the guide member 65 so that there is a predetermined space between the bosses 84 and the restricting part 83 in a state that the shaft body has no bend. Therefore, if the shaft body 60 is deformed with a predetermined quantity, the bosses 84 contacts the restricting part 83 and then, the further deformation of the shaft body 60 is prevented. Accordingly, it is possible to return the paper P appropriately.

Next, the shape of the lever 59 will be explained with reference to FIG. 18 and other drawings if required. As described above, since the edge of the following papers P being driven by the top paper stays around the nipping point of the feed roller 53 and the retard roller 61, the rotational region of the lever 59 is provided so that the rotational region overlaps the nipping point in order to trip the edge of the following papers P without fail. Therefore, the top paper P is slightly waved in the width direction by the nipping point and the lever 59 as shown in FIG. 18.

However, if the top paper P is transported with such state, the rear face of the paper P is transported slipping on the lever 59 having the friction. Thus, in the duplex printing for a postcard, in which the front face of the postcard is recorded and next, the rear face of the postcard is recorded, it is feared that the recording quality falls because of scratches. In addition, if using pigment ink, the deterioration in recording quality is easy to occur in comparison with using dye ink, because of the friction with the lever 59. Thus, in this embodiment, the contact surface of the lever 59 with paper P is formed to be along the contact part of the paper P with the feed roller 53. In other words, the contact surface of the lever 59 with paper P is formed to fit the wave-like shape that is formed along the width direction by the lever 59, the feed roller 53 and the retard roller 61.

Figure 18A:
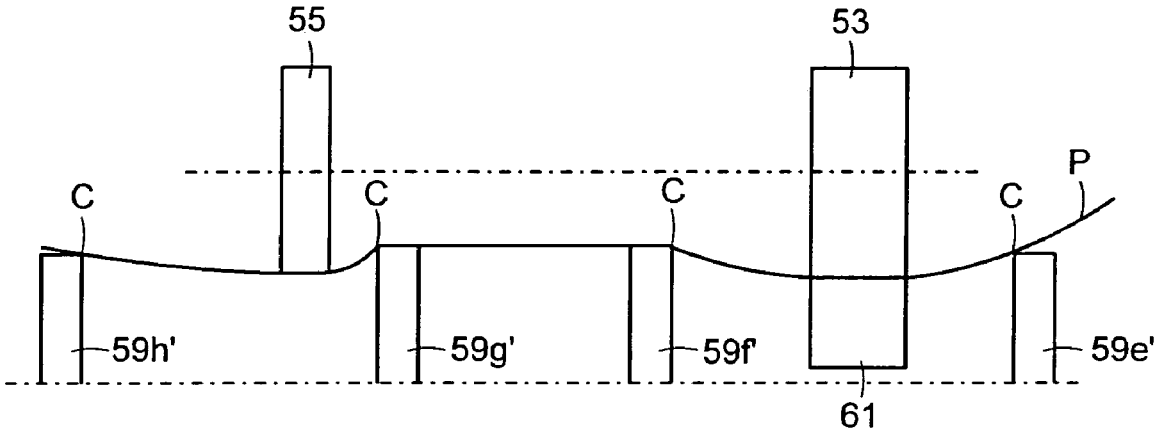
RELATED ART FIG. 18A
FIG. 18A shows a returning levers 59*h*', 59*g*', 59*f*' and 59*e*' according to a related art.
Figure 18B:
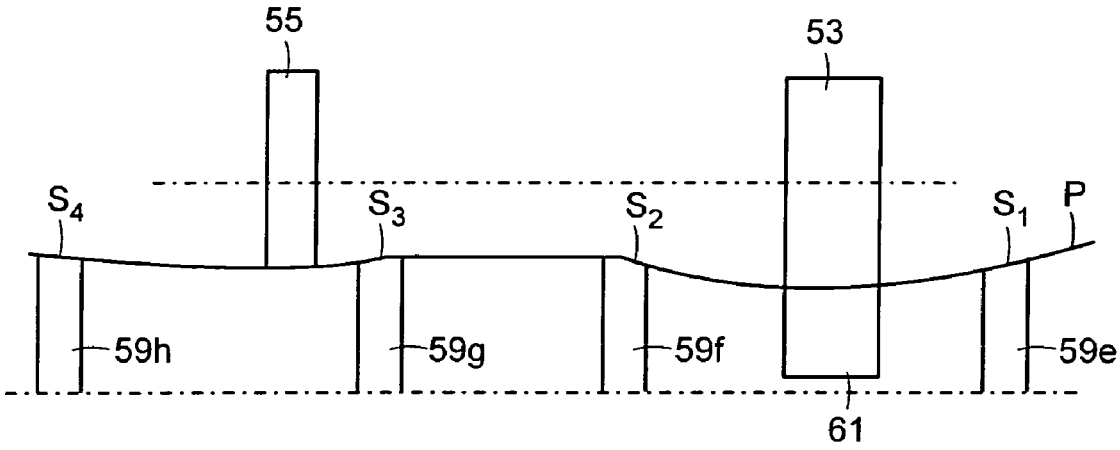
FIG. 18B is a front view of the lever 59 according to this embodiment.

More specifically, in FIG. 18A showing are turning levers 59*h*', 59*g*', 59*f*' and 59*e*' (which are called "a lever 59'") according to a related art, the paper P is formed to be wave-like shape in the width direction of the paper. Thus, a corner C may hurt the rear face of the paper P, and therefore, some scratches may be generated. FIG. 18B shows the lever 59 according to this embodiment. In this embodiment, contact surfaces S1 and S2 are formed to be along the contact part of the paper P with the feed roller 53, and contact surfaces S3 and S4 are formed to be along the contact part of the paper P with the auxiliary roller 55. Therefore, the contact surfaces S1–S4 are formed to be fitted to the wave-like shape that is formed in the width direction. In other words, the paper P is, so to speak, in face contact with the lever 59, and consequently the deterioration in recording quality can be prevented notably.

In addition, the present invention can be used as a recording apparatus such as a FAX machine and a printer, and a liquid ejecting apparatus for ejecting liquid to the ejected medium from a head.

Although the present invention has been described by way of exemplary embodiments, it should be understood that those skilled in the art might make many changes and substitutions without departing from the spirit and the scope of the present invention which is defined only by the appended claims.

What is claimed is:

1. A recording medium feeding apparatus comprising:

a feed roller provided on a feed roller shaft that is rotatably driven to feed recording medium to a downstream side in said recording medium feeding apparatus in contact with the recording medium;

a hopper provided pivotable between a first state in which the recording is abutted against said feed roller and a second state in which the recording medium is spaced apart from said feed roller, supporting the recording medium in inclined attitude and a narrowing means including, a driven roller that is rotatably driven in contact with the recording medium at a contact position of the recording medium; and a movable member provided near said feed roller and being movable backward and forward toward a feeding path of the recording medium, so that said narrowing means narrows a clearance between said feed roller and said hopper in the second state.

2. The recording medium feeding apparatus as claimed in claim 1, wherein said movable member escapes from the feeding path in the first state, whereas said movable member enters into the feeding path in the second state in order to narrow the clearance.

3. The recording medium feeding apparatus as claimed in claim 1, wherein said movable member includes:

a body of which a bottom face is provided to be opposed to the feeding path;

a first driven roller provided at an upstream corner on the bottom part of said body; and a second driven roller provided at a downstream corner of the bottom part of said body.

4. The recording medium feeding apparatus as claimed in claim 2, wherein said movable member includes:

a body of which a bottom face is provided to be opposed to the feeding path;

a first driven roller provided at an upstream corner of the bottom part of said body; and a second driven roller provided at a downstream corner of the bottom part of said body.

5. The recording medium feeding apparatus as claimed in claim 3, wherein said first driven roller and said second driven roller are provided near an intersection position of a flat part of said feed roller and a circular arc part of said feed roller.

6. The recording medium feeding apparatus as claimed in claim 4, wherein said first driven roller and said second driven roller are provided near an intersection position of a flat part of said feed roller and a circular arc part of said feed roller.

7. The recording medium feeding apparatus as claimed in claim 3, wherein said body is provided pivotable around a rotation shaft of said second driven roller, and includes a cam follower engaging with a cam that is provided at said feed roller shaft, so that said body moves backward and forward to the feeding path in accordance with rotation of said feed roller shaft.

8. The recording medium feeding apparatus as claimed in claim 4, wherein said body is provided pivotable around a rotation shaft of said second driven roller, and includes a cam follower engaging with a cam that is provided at said feed roller shaft, so that said body moves backward and forward to the feeding path in accordance with rotation of said feed roller shaft.

9. The recording medium feeding apparatus as claimed in claim 5, wherein said body is provided pivotable around a rotation shaft of said second driven roller, and includes a cam follower engaging with a cam that is provided at said feed roller shaft, so that said body moves backward and forward to the feeding path in accordance with rotation of said feed roller shaft.

10. The recording medium feeding apparatus as claimed in claim 6, wherein said body is provided pivotable around a rotation shaft of said second driven roller, and includes a cam follower engaging with a cam that is provided at said feed roller shaft, so that said body moves backward and forward to the feeding path in accordance with rotation of said feed roller shaft.

11. A recording medium feeding apparatus comprising:

a feed roller provided on a feed roller shaft that is rotatably driven to feed recording medium to a downstream side in said recording medium feeding apparatus in contact with the recording medium;

a hopper provided pivotable between a first state in which the recording medium is abutted against said feed roller and a second state in which the recording medium is spaced from said feed roller supporting the recording medium in inclined attitude; and an edge supporting part for supporting an edge of the recording medium that is supported by said hopper in the inclined attitude; wherein a first guide part for guiding the edge of the recording medium to said edge supporting part when the recording medium is set, and a second guide part for guiding the edge of the recording medium to a downstream side of said edge supporting part when the recording medium is fed, intersect together to form a corner, and wherein said corner at a guide member that is provided operable to be displaced in the feeding path of the recording medium is formed to be covered with a circumference of a driven roller that is rotatably driven in contact with the recording medium at a contact position of the recording medium.

12. A recording medium feeding apparatus comprising:

a feed roller provided on a feed roller shaft that is rotatably driven to feed recording medium to a downstream side of said recording medium feeding apparatus in contact with the recording medium;

a hopper provided pivotable between a first state in which the recording medium is abutted against said feed roller and a second state in which the recording medium is spaced from said feed roller supporting the recording medium in inclined attitude;

an edge supporting part for supporting an edge of the recording medium that is supported by said hopper in the inclined attitude;

a separation means for nipping the recording medium between said feed roller and said separation means in order to separate top recording medium to be fed from following recording medium next to the top recording medium; and a guide member that is provided operable to be displaced in the feeding path of the recording medium; wherein said guide member includes:

a first guide part for guiding the edge of the recording medium to said edge supporting part when the recording medium is set;

a second guide part for guiding the edge of the recording medium to said separating means a downstream side of said edge supporting part when the recording medium is fed; and a driven roller which is provided at an upstream side of said second guide part and is rotatably driven in contact with the recording medium.

13. The recording apparatus including a recording part for recording in recording medium, comprising: said recording medium feeding apparatus cited in claim 1.

14. The recording apparatus including a recording part for recording in recording medium, comprising: said recording medium feeding apparatus cited in claim 11.

15. The recording apparatus including a recording part for recording in recording medium, comprising: said recording medium feeding apparatus cited in claim 12.

16. A liquid ejecting apparatus comprising:

a feed roller formed to be substantially D-shaped in side view including a circular arc part and a flat part, and provided at a feed roller shaft that is rotatably driven, thereby rotating in contact with the recording medium to feed ejected medium to a downstream side in said liquid ejecting apparatus;

a hopper provided pivotable between a first state in which the recording is abutted against said feed roller and a second state in which the recording medium is spaced apart from said feed roller, supporting the recording medium in inclined attitude;

a transport means provided in a downstream side of said feed roller to transport the ejected medium to the downstream side;

a liquid ejecting means provided in a downstream side of said transport means to eject liquid to the ejected medium; and a narrowing means including:

a driven roller that is rotatably driven in contact with the recording medium at a contact position of the recording medium; and a movable member that is provided near said feed roller being movable backward and forward toward a feeding path of the recording medium, so that said narrowing means narrows a clearance between said feed roller and said hopper in the second state.

17. A recording medium feeding apparatus for feeding recording medium comprising:

a frame;

a feed roller shaft rotatably supported on said frame;

a feed roller rotatably supported on said feed roller shaft in contact with the recording medium;

a hopper supporting the recording medium at an upstream side of said recording medium feeding apparatus, and supported on said frame in an inclined attitude corresponding to a vertical direction of said recording medium feeding apparatus being pivotable between a first position where the recording medium is elastically abutted against said feed roller and a second position spaced apart from said feed roller; and a body provided near a downstream part of said hopper and said feed roller, wherein said body including a first guide part, and a driven roller that is rotatably supported on said first guide part where said driven roller contacts the recording medium when said body is in said first position, and said driven roller is urged in a direction toward said hopper operatively in association with said feed roller.

18. The recording medium feeding apparatus as claimed in claim 17, further comprising a retard roller rotatably supported by said frame at a position downstream of said hopper, wherein the friction between said retard roller and the recording medium is larger than that between one recording medium and another recording medium.

19. The recording medium feeding apparatus as claimed in claim 18, wherein the friction between said feed roller and the recording medium is larger than that between one recording medium and another recording medium, when said hopper stands at the first position.

* * * * *